US009039584B2

(12) United States Patent
Chiang

(10) Patent No.: US 9,039,584 B2
(45) Date of Patent: May 26, 2015

(54) MARTIAL ARTS TRAINING DEVICE

(76) Inventor: Stephen Chiang, Voorhees, NJ (US)

( * ) Notice: Subject to any disclaimer, the term of this patent is extended or adjusted under 35 U.S.C. 154(b) by 68 days.

(21) Appl. No.: 13/551,269

(22) Filed: Jul. 17, 2012

(65) Prior Publication Data

US 2014/0024503 A1 Jan. 23, 2014

(51) Int. Cl.

| | |
|---|---|
| ***A63B 21/00*** | (2006.01) |
| ***A63B 69/00*** | (2006.01) |
| ***A63B 69/34*** | (2006.01) |
| *A63B 71/02* | (2006.01) |

(52) U.S. Cl.

CPC ..... *A63B 69/004* (2013.01); *A63B 69/34* (2013.01); *A63B 2071/026* (2013.01); *A63B 2210/50* (2013.01); *A63B 2244/10* (2013.01)

(58) Field of Classification Search

USPC ..... 482/83–90

See application file for complete search history.

(56) References Cited

U.S. PATENT DOCUMENTS

| | | | | |
|---|---|---|---|---|
| 2,253,758 | A * | 8/1941 | Bulloch | 482/148 |
| 2,526,217 | A * | 10/1950 | Gilman | 473/444 |
| D169,243 | S | 4/1953 | Doherty | |
| 4,546,966 | A * | 10/1985 | Segura | 482/88 |
| 5,256,069 | A * | 10/1993 | Snowden et al. | 434/247 |
| 5,554,088 | A * | 9/1996 | Zlojutro | 482/83 |
| 5,800,319 | A | 9/1998 | Choate | |
| 6,063,011 | A * | 5/2000 | Pelchat | 482/83 |
| 6,077,204 | A | 6/2000 | Dickinson, Jr. | |
| 6,302,831 | B1 * | 10/2001 | Henry | 482/83 |
| 6,309,327 | B1 * | 10/2001 | Hallberg | 482/83 |
| 6,808,477 | B2 * | 10/2004 | Tudor | 482/83 |
| D584,785 | S | 1/2009 | McDonald | |
| 8,029,422 | B2 | 10/2011 | Strong et al. | |
| 2004/0005963 | A1 * | 1/2004 | Tudor | 482/83 |
| 2009/0098985 | A1 * | 4/2009 | Gonzalez | 482/83 |
| 2014/0066266 | A1 * | 3/2014 | Chang | 482/83 |

* cited by examiner

*Primary Examiner* — Jerome W Donnelly
(74) *Attorney, Agent, or Firm* — Caesar Rivise, PC

(57) ABSTRACT

A martial arts training system has a solid body formed of resilient material with a front surface, a back surface, side surfaces, a top surface, and a bottom surface. The front surface has a number of holes arranged thereon for receiving at least one accessory member. The system has at least one accessory having an attachment section shaped and sized to be received in a hole of the front surface and a training section adapted to extend from the front surface to form a contact target, such as an arm, leg, or weapon.

33 Claims, 23 Drawing Sheets

MARTIAL ARTS TRAINING DEVICE

FIELD OF THE INVENTION

The disclosed embodiments relate to a martial arts training device. In particular, the disclosed embodiments relate to a martial arts training device which can be used for hand-to-hand combat training in diverse training contexts, such as civilian, military, law enforcement, etc., and which is configurable to simulate a range of armed and unarmed opponents to provide both offensive and defensive training, and which is effective for both solo training and for training with a partner.

BACKGROUND OF THE INVENTION

"Striking" martial arts and hand-to-hand combat systems have existed for millennia in both Eastern and Western Hemispheres. These systems and styles have been used and practiced in such diverse demographic segments as general civilian populations (Kung-Fu, Karate, Tae Kwon Do, Savate), professional sporting competitors (Boxing, Kickboxing/Muay Thai, MMA), military personnel (MCMAP, Krav Maga), and law enforcement officers/agents (Taiho Jutsu), among other groups. Such combat systems that involve striking techniques utilize body parts (fists, palms, elbows, feet, knees, etc.) as well as non-ranged, melee weapons (swords, bayonets, batons, etc).

Practitioners of such martial arts styles and hand-to-hand combat systems commonly use a variety of devices and apparatuses to train, drill and improve their techniques. One of the most common is the heavy bag, which has existed in some form or another since the advent of striking arts, whether made of animal hide and filled with sand or made of modern plastics and filled high-density synthetic gel. Another well-known device is the Wing Chun Kung Fu Wooden Dummy which has been, and continues to be, associated with advanced close-quarter hand-to-hand combat training—in both actual instruction and popular media. Two of the most fundamental reasons that such martial arts training devices have existed, can continue to exist, are: (1) another human training partner may not always be available, and (2) even if another human training partner is available, one cannot safely practice full-force striking on a human partner, even if the partner is wearing training padding, unless one is intentionally trying to harm that partner or "go for a knockout."

All training devices for the striking arts, from historically generic devices such as the heavy bag, to even recently-patented devices such as U.S. Pat. No. 8,029,422, may be evaluated and analyzed according to seven fundamental metrics: (1) Platform Mobility/Human Interactivity, (2) Available Training Spectrum, (3) System Completeness, (4) Configurability, (5) Demographic Usability, (6) Ease of Deployment, Storage & Transport, and (7) Cost-to-Training-Benefit Ratio. While no training device known to the inventor has high values across all of these characteristics, it would be desirable for a single training device to embody these seven fundamental metrics in a robust manner.

(1) The evaluation factor, "Platform Mobility/Human Interactivity," largely depends on the device's size, weight, and shape. Bulky devices such as heavy bags and wooden dummies are virtually completely immobile, e.g., mounted on walls, heavy bases, or suspended from the ceiling/overhead structures. Because these devices are fixed-position platforms, they cannot be handheld by a human partner and have no potential for the spontaneous human interactivity and training challenges that a partner can provide. Other larger devices, such as the foam body shield, and smaller ones, such as the focus mitt, are handheld platforms that allow for human interactivity, for example, where the holding partner may manually manipulate the device to simulate a moving target. However, in the absence of a partner, these handheld, mobile-platform devices have severely reduced training potential to a solo practitioner. It would be valuable for a training device to be able to be effective both as a stand-alone, static apparatus as well as providing a high degree of human interactivity when a partner is available to manipulate it in a mobile manner.

(2) The evaluation factor, "Available Training Spectrum," describes how robust a device is in terms of providing for training in different sub-categories of both offensive and defensive techniques. Devices such as the heavy bag and smaller wall-mounted pads, such as the makiwara, are "target-only" and thus are restricted to the practice of offensive techniques such as punches and kicks. Furthermore, target-only devices often provide curtailed categories of offensive training due to limitations in: (i) size of available targeting area, (ii) available striking vectors, and/or (iii) limit for safe striking force. For example, a heavy bag: (i) provides substantial targeting area, (ii) allows for several striking vectors, such as frontal straight attacks like jab punches and front kicks, and side-vectoring attacks such as hook punches and spinning kicks, but cannot meaningfully accommodate vertically-vectored attacks such as rising uppercut punches or falling axe kicks, and (iii) has only a moderate limit for safe striking force; because the heavy bag has significant density, weight, and inertia, and therefore less "give" than a human body, striking it at full force can result in a recoiling force that may harm a practitioner's joints, bones, and soft tissue. The smaller makiwara, on the other hand: (i) has a limited targeting area, (ii) provides only one primary striking vector, frontal straight, and (iii) also has a low limit for safe striking force, given that it is often wall-mounted and thus often completely immobile. Handheld, partnered devices generally allow for better offensive training along these dimensions as they: (i) have the potential to offer significant targeting area, (ii) can be manipulated by a partner to offer multiple striking vectors, and (iii) are often softer and lighter and can therefore be struck safely with a high degree of force. However, the usefulness of handheld devices disappears when a partner is unavailable, and many of them, such as the body shield, are for offensive-training only ("target-only"). While there exist devices that allow for both offensive and defensive technique practice, such devices tend to be similarly limited to one of the two primary defense types: either (a) Contact Defenses, such as parrying/blocking, or (b) Non-Contact Defenses, such as evasion. The famous Wing Chun Kung Fu Wooden Dummy provides a fixed array of 3 protruding arms and one leg. Practitioners can practice Kung-Fu style blocking and other contact defenses on the protrusions while delivering counter-attacks to the central trunk, but the wooden dummy provides much less training potential for non-contact, evasive defenses such as ducking and dodging. On the other hand, in Boxing, a trainer may don two focus mitts and hold them up as moving targets for the boxer to punch; additionally, the trainer may also swing or jab one or both focus mitts at the boxer for the boxer to practice evasive defenses such as bobbing and weaving. However, the focus mitts are seldom, if ever, used to effectively hone contact defenses such as direct forearm blocking. Therefore, while only a small minority of devices exist that provide training for some offensive and some defensive techniques, such devices are more accurately described as incomplete-spectrum training devices, as they typically have limitations on both the offensive and defensive technique categories for which they are effective. It would therefore be valuable for a single device to offer a truly full-spectrum training potential where a practitioner can work on all elements of all categories of offensive and defensive techniques.

(3) The evaluation factor, "System Completeness," refers to whether a device is usable by itself for training as a self-contained system, or whether a device is useful only as an accessory to enhance a separate, existing device. Common devices such as the heavy bag, wooden dummy, makiwara, body shield, and speed bag, among others, are self-contained systems. Self-contained systems also include devices such as those disclosed in U.S. Pat. No. D169,243, an "ornamental" heavy bag design, and U.S. Pat. No. 8,029,422, a target-only device with a single, soft striking plane. Contrarily, other devices are accessories, which require to be attached to other self-contained systems for the sole purpose of enhancing that system. Most of these accessories are intended to be affixed to a conventional heavy bag to either increase targeting surface area, such as the common "clapper"-type attachments, or, popularly, to mimic the functionality of the classic wooden dummy-type protrusions and layout, such as in U.S. Pat. No. 5,800,319; U.S. Pat. No. 6,063,011; U.S. Pat. No. D584,785; and U.S. Pat. No. 6,302,831. It is important to note that without a proper, separate self-contained system to attach to, these accessory-type devices are useless by themselves. Accordingly, it would be desirable for a martial arts training system to be a completely self-contained system which includes its own specific, pre-existing, multi-functional accessories.

(4) The evaluation factor, "Configurability," reflects a device's inherent capacity to be adapted into alternative forms and additional functions for a broader training experience. Most, if not all, common and known devices, such as the heavy bag (which is a "target-only" device), and the wooden dummy (which provides an incomplete training spectrum), are not designed to be configurable into a multiplicity of different iterations, because they have one fixed form and inherently limited function and may only be configured in a limited manner by third-party accessories, if at all. In other words, conventional striking training devices are not at all meaningfully configurable as a single, self-contained unit. It would be valuable for a single device to be self-configurable for a multitude of functions, without requiring separately purchasing third-party accessories.

(5) The evaluation factor, "Demographic Usability," measures a device's relevance to the unique training needs of a particular practitioner demographic. The heavy bag and body shield are usable by civilian, sporting, military, and law enforcement demographics, because the hand-to-hand combat repertoires of such diverse demographics share some basic, overlapping techniques (for example, generic punches) appropriate for training with these common devices. However, there exist specialized training devices intended to serve the unique and specific needs of certain demographics. For example, the "tire man" is an outdoor, fixed-platform device frequently used for infantry bayonet melee training. Devices that are usable by multiple demographics, such the body shield, tend to be generic devices which are simpler in design and limited in functionality, i.e., military personnel may use a body shield to train common, unarmed striking techniques such as basic punches and kicks, but require the separate tire man to train bayonet techniques. At the same time, such specialized, non-generic devices such as the tire man are often exclusively relevant and only useful to a specific demographic. That is, the tire man is very useful to military personnel/infantry who would be armed with a bayonet, but the tire man has virtually no relevance or training value vis-à-vis the needs of, for instance, an MMA kickboxer or police officer, who would never carry a bayonet. Furthermore, many different demographics also train in the use of different types of weapons, and there exists very few devices that are applicable to weapons training, let alone that are applicable to a diverse range of weapons. It would therefore be very valuable for a single device to be broadly relevant to as many of the training needs of as many different demographics as possible, including training involving a diverse variety of weapons.

(6) The evaluation factor, "Ease of Deployment, Storage & Transport," relates to the user-friendliness of the device, which can significantly affect an individual's or organization's decision regarding whether to acquire a training device, and/or how many of the devices should be acquired. Many of the most popular and traditional combat striking training devices, such as the heavy bag and wooden dummy, are very heavy and require considerable set-up time and effort. Once they are deployed, e.g., usually mounted to a ceiling, wall, or other load-bearing structure, they are very difficult to move, let alone store in or transport to a different room or location. Conversely, smaller and lighter devices such as a focus mitt or body shield may be more convenient to store and transport, but requires a human partner to properly deploy, and cannot be meaningfully self-deployed by a solo practitioner; that is, one cannot effectively hold a target for oneself to punch or kick. Analogously, devices which are by design strictly accessories, such as those disclosed in U.S. Pat. No. 6,063,011 and U.S. Pat. No. D584,785, require a larger self-contained system or device to attach to in order to be deployed, and by themselves are functionally useless. It would be desirable for a device to be easily deployed, stored, and transported, and yet still provide high value in the other fundamental characteristics.

(7) The evaluation factor, "Cost-to-Training-Benefit-Ratio," ("CTBR") is another primary consideration for individual practitioners and organizations in the device-acquisition decision making. Larger, bulkier, fixed-position devices such as heavy bags can costs hundreds of dollars, while wooden dummies can cost over a thousand dollars, as well as likely requiring additional expenditures of funds, time, and effort to correctly deploy. The CTBR advantages of larger devices, such as the heavy bag and wooden dummy, generally arise, for example, from characteristics such as their higher durability, but are counterbalanced by CTBR disadvantages such as less ease in deployment, storage, transport, and lack of human interactivity. While smaller devices such as focus mitts cost significantly less, their CTBR is virtually nil when no partner is available. Other smaller items such as speed bags and makiwaras that do not require a partner may have a lower price point, but also have overall lower CTBR due to inherent form and function limitations, such as limited targeting areas, limited available striking vectors, and limited training spectrum. Attachment devices similar to those disclosed in U.S. Pat. No. 5,800,319, U.S. Pat. No. 6,302,831, and U.S. Pat. No. D584,785, can be relatively costly, in many instances in the hundreds of dollars. Moreover, these devices typically must be attached to an also costly, separate device, such as a heavy bag; otherwise, these accessory-type devices have no meaningful CTBR on their own, when detached. It would be very valuable for a single device to combine a reasonable price point and robust characteristics that would support a high CTBR.

There is no prior art combat/striking/melee training device known to the inventor which possesses such high values in all seven of the afore-mentioned fundamental, device-evaluation metrics.

SUMMARY OF THE INVENTION

The disclosed embodiments are directed to a martial arts training device having a wide range of important training functionalities and desirable performance characteristics in a totality not possessed by any known devices. The device has a base unit which approximates the size of an opponent's torso and which functions as a sizeable target for all manner of offensive techniques, including but not limited to, punches, kicks, and weapons strikes.

In addition to serving as a target of considerable size, the device has a plurality of apertures on its targeting surface to which a variety of specifically-designed accessories may be attached, to form a self-enhancing, and self-contained, complete system capable of transforming into a multitude of diverse training configurations. These accessories simulate the size and shape of an opponent's arms, legs, and/or a variety of historical and modern weapons. The accessories allow the practitioner to treat them as if they were an opponent's incoming limb(s) and/or weapon(s) and accordingly train both types of defensive techniques, i.e.: contact interceptions such as parrying and blocking, and non-contact evasions such as dodging, bobbing and weaving. The distribution of the apertures includes columns covering at least the right and left sides, as well as the "centerline" of the device. The centerline is a vertical meridian which runs along the vertical center of an opponent's torso and is considered by many martial art styles to be an optimal reference and focal point for offensive and defensive techniques. The aperture distribution in vertical columns along the left side, right side, and centerline for attaching the accessories creates distinct and useful simulations of incoming strikes originating from those three primary vertical axes for comprehensive training, i.e., the accessories simulate strikes incoming from an opponent's right, left, and center—and also at different height levels, such as head, chest, abdomen, etc.

The combination of the base unit's primary targeting surface with the attachment of a single or several accessories can re-create a multitude of traditional configurations ranging from the venerable Wing Chun Kung Fu Wooden Dummy, to a Boxing trainer swinging both arms, to new, unconventional and custom configurations. Thus, the device has adaptive form-and-function capabilities far beyond those of conventional devices.

The main body/base and attachable accessories may be constructed from a lightweight, resilient material, such as ethylene vinyl acetate ("EVA") or polyurethane foam, which allows the practitioner to: strike the device with considerable force without significant risk of self-injury; easily mount the invention to a wall, doorway, or other support structure for use as a static apparatus during solo training; have a partner easily manipulate the device in a handheld orientation as a mobile apparatus for spontaneous interactive training; and enjoy its user-friendliness and simplicity of deployment, storage, and transportation. The device can accommodate additional attachable accessories, beyond the aforementioned arms and legs, which pertain to the unique training needs of specific demographics, such as a simulated enemy rifle and bayonet accessory for military melee training, among other illustrated and prospective accessories. The device also can incorporate the attachment of additional targeting pads for completely comprehensive multi-vector striking, as well as aperture plugs to increase available targeting surface area.

In one aspect of the disclosed invention, a martial arts training system includes a solid body formed of resilient material and having a front surface, a back surface, side surfaces, a top surface, and a bottom surface. The front surface has a plurality of holes arranged thereon for receiving at least one accessory member. The system further includes at least one accessory having an attachment section shaped and sized to be received in a hole of the plurality of holes of the front surface and a training section adapted to extend from the front surface.

Embodiments of the disclosed invention may include one or more of the following features. The training section of the at least one accessory may include an elongate and substantially cylindrical member which forms a striking target, or more generally, a contact target representing an opponent's arm. The attachment section of the at least one accessory may include an elongate and substantially cylindrical member having a diameter smaller than a diameter of the training section. The training section of the at least one accessory may include an elongate and substantially cylindrical member having a bend which forms a contact target representing an opponent's incoming or leading leg. The training section of the at least one accessory may include an elongate member which forms a contact target representing a rifle with a bayonet. The training section of the at least one accessory may include an elongate member which forms a contact target representing an opponent's forearm and hand holding a gun. The training section of the at least one accessory may include an elongate member which extends from the front surface at a combat-simulating angle (for example, from 30 degrees to 60 degrees) and forms a contact target representing a martial arts or melee weapon, such as a sword, club, dagger, bat, etc. The training section of the at least one accessory may include a planar targeting pad which extends perpendicularly from the front surface and forms a contact target. The training section of the at least one accessory may include a shallow semi-spherical protrusion which covers and "plugs" otherwise vacant apertures to increase useful targeting area, e.g., a targeting plug having a training section with a diameter greater than a diameter of the hole in which the training plug is received and which forms a contact target.

BRIEF DESCRIPTION OF THE DRAWINGS

The above and/or other aspects and advantages will become more apparent and more readily appreciated from the following detailed description of the disclosed embodiments taken in conjunction with the accompanying drawings of which.

DETAILED DESCRIPTION OF THE DRAWINGS

Figure 1:
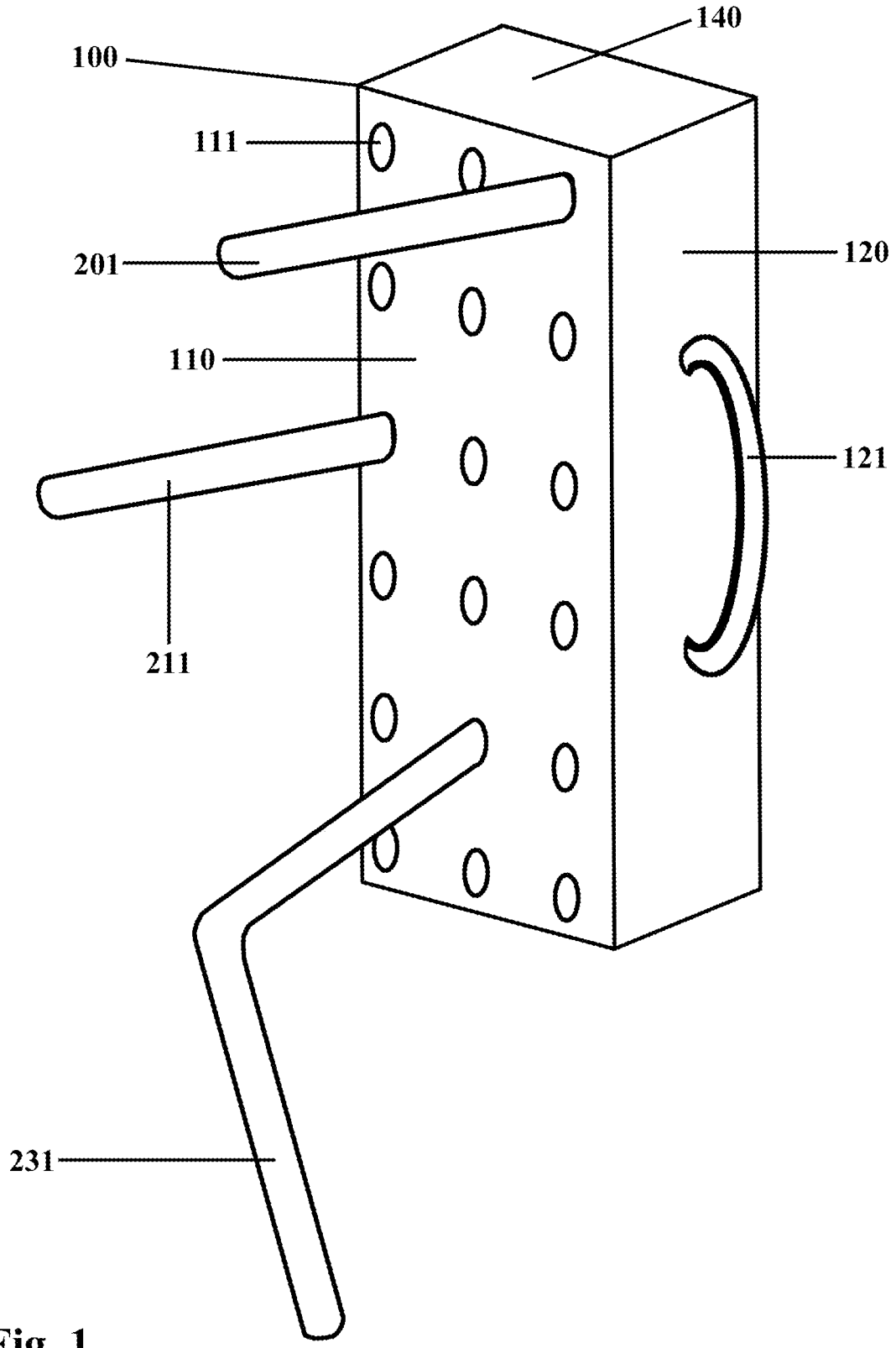
FIG. 1 is a perspective view of an embodiment of a martial arts training device with two arm accessories and one leg accessory attached in a custom variant of a traditional wooden dummy configuration.

FIG. 1 depicts a perspective view of the body or "base unit" 100 of a martial arts training device. The training device body 100 is oriented in an upright manner, where the top side 140 faces the ceiling, which is the device's primary orientation consistent with being mounted on a support structure such as a wall, stand, etc., or with being manually-held by a training partner. One vertical handle 121, attached to a flank side 120, is visible in this view. The primary-user interface for a practitioner is the front surface 110, which in this embodiment, is a rectangular targeting surface with a width and height that approximates an opponent's shoulder width and trunk length, e.g., about 15 inches wide and about 35 inches high, although these dimensions may vary, for example, by about 1 or 2 inches each way. The front surface has a plurality of apertures

111 for insertion and attachment of accessories. Each aperture 111 is of sufficient width and depth (e.g., between about 1 inch and about 3 inches wide, and between about 5 inches and about 10 inches deep) to snugly hold and secure an accessory's attachment section during training contact.

In this embodiment, there are three vertical columns of six approximately evenly-spaced apertures. The even spacing helps prevent one aperture from affecting the accessory-holding integrity of another proximal aperture. Each vertical column corresponds to a primary directional origin where an opponent may launch an attack, i.e., from the left side, centerline, and right side. The even, vertical spacing of the apertures allows for placement of accessories corresponding to incoming targeting heights on the practitioner, from literally foot/ankle elevation to head-elevation, based on the mounting or training partner's grip position. In a conventional Wing Chun Kung Fu Wooden Dummy, by contrast, the arms and legs are configured in fixed, permanent positions, i.e., two arms simulating shoulder/chest-elevation attacks originating from the left and right sides, one arm simulating a midsection-elevation attack originating from the centerline, and one leg simulating a groin/leg-elevation attack originating from the centerline.

The plurality of apertures 111 provided on the front surface 110 of the base unit 100 provides for the potential for a multitude of different arm/leg/accessory configurations. In the embodiment of FIG. 1, for example, two simulated opponent arms with training sections 201, 211 protruding. The training section 211, configured at a lower elevation, simulates an incoming attack to the practitioner's left-midsection, while the training section 201, configured at a higher elevation, simulates an incoming attack to right-side of the practitioner's head. The exposed training section 231 of the leg attachment simulates an incoming low-elevation, centerline frontal attack, such as a low front kick. The body 100 and accessory training sections 201, 211, and 231, may be fabricated of a soft material, for example, ethylene vinyl acetate (EVA) or dense polyurethane foam. By "soft," it is meant that the material has "give," i.e., the material compresses, in response to a blow, as opposed to, for example, a conventional hard practice bag. The material also has a certain degree of firmness, which allows the body 100 to maintain its shape, i.e., the body is resilient, when loaded with accessories. Therefore, the material can absorb a full-force strike and/or parry so that a practitioner may train with full-force offensive and defensive techniques with greatly reduced potential for recoil-related, self-injury. Also, the lightweight nature of such material allows the device to be easily deployed, whether mounted on a stand or wall, or hand-held by a training partner; also, such lightweight material provides for quick and convenient storage and transport. The base unit 100 and accessories may be, for example, fabricated from solid, closed-surface foam such as EVA. Alternatively, the base unit 100 and accessories, if fabricated from a porous foam such as polyurethane, may be covered with a pliable covering such as, for example, vinyl or plastic.

The disclosed embodiments provide a martial arts/striking system training device which is robust in all elements of the seven fundamental training device metrics discussed above. The disclosed device: (1*a*) can serve as an effective wall-mounted or stand-mounted static apparatus for when the practitioner engages in solo training; (1*b*) can serve as an effective interactive mobile training device when held by and manipulated by a partner; (2*a*) provides ample targeting area for offensive techniques; (2*b*) provides targeting surfaces for all possible striking vectors for offensive techniques; (2*c*) provides a high threshold of safe striking force for offensive techniques; (2*d*) allows for effective training of contact defenses, such as parrying/blocking techniques; (2*e*) allows for effective training of non-contact defenses, such as evasive techniques; (2*f*) is a bona fide full-spectrum offensive and defensive training device; (3*a*) is a complete and self-contained training system; (3*b*) includes an array of accessories and additions that are custom-designed for self-enhancement; (3*c*) does not require or depend on third-party accessories; (4*a*) is highly configurable to simulate a wide range of opponents and tactical scenarios; (4*b*) can be configured to function as a basic target-only device; (4*c*) can be configured, as a single unit, to provide a variety of targeting vectors and full spectrum training without requiring additional separate units; (5*a*) can serve the common and overlapping training needs of major, diverse demographics, including but not limited to, civilian use, military training, and law enforcement purposes; (5*b*) can serve the unique and specific training needs of major, diverse demographics; (5*c*) can serve both the unarmed and weapons-based training purposes of major, diverse demographics; (6*a*) is simple and quick to deploy; (6*b*) can be easily stored; (6*c*) is convenient to transport; (6*d*) is user-friendly without compromising other important characteristics; (7*a*) has a high CTBR due to its prospective, reasonable price point; and (7*b*) has a high CTBR dues to its retention and maintenance of high values in all of the seven device metrics.

Figure 2:
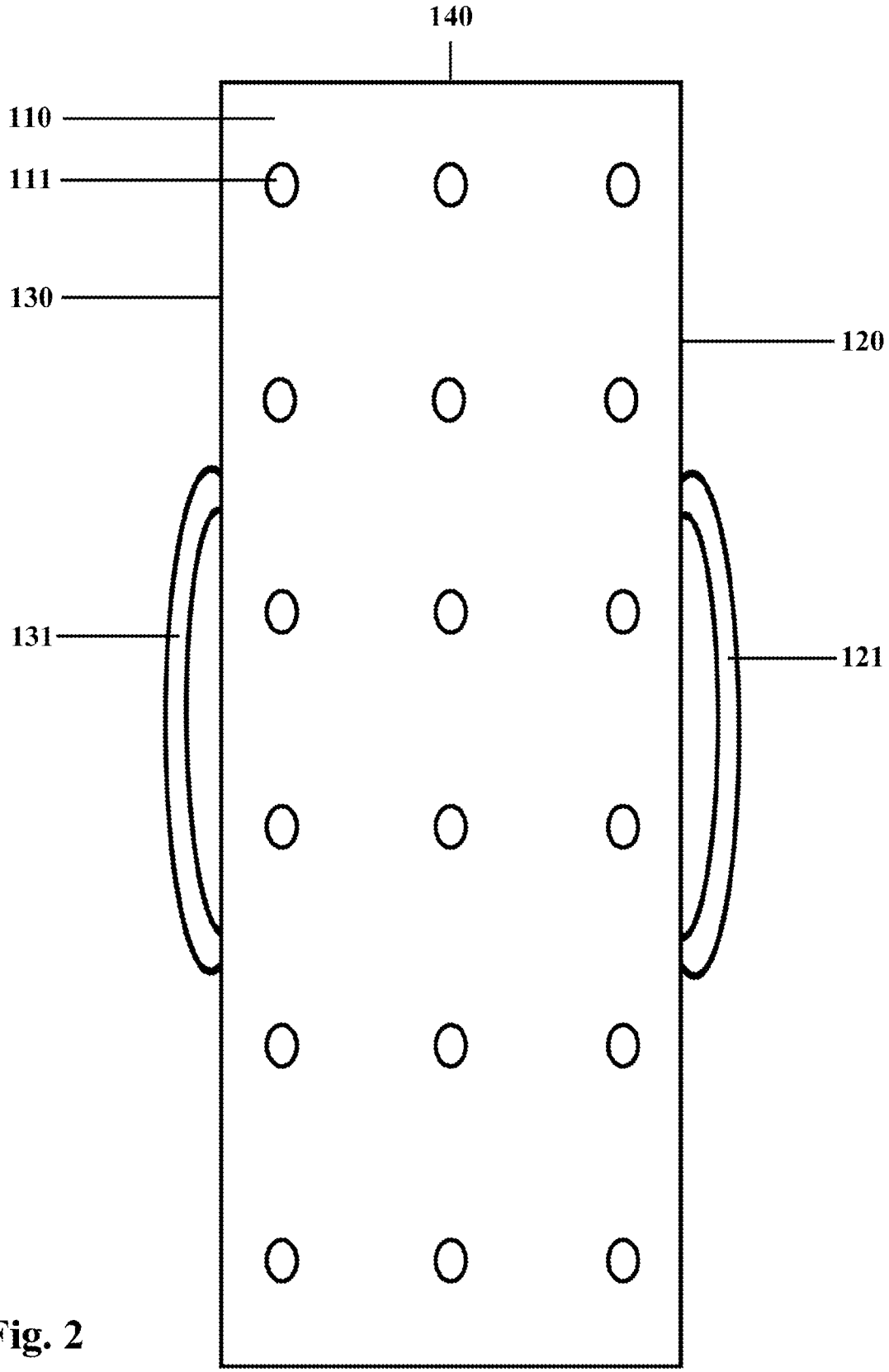
FIG. 2 is a level, frontal view of the martial arts training device without any accessories attached.

FIG. 2 is a level view of the front surface 110 with its rectangular profile in full view, with the top surface 140 oriented upwards, with all accessory apertures 111 unoccupied. Vertical handles 121, 131 are attached to the two flank surfaces 120, 130.

Figure 3:
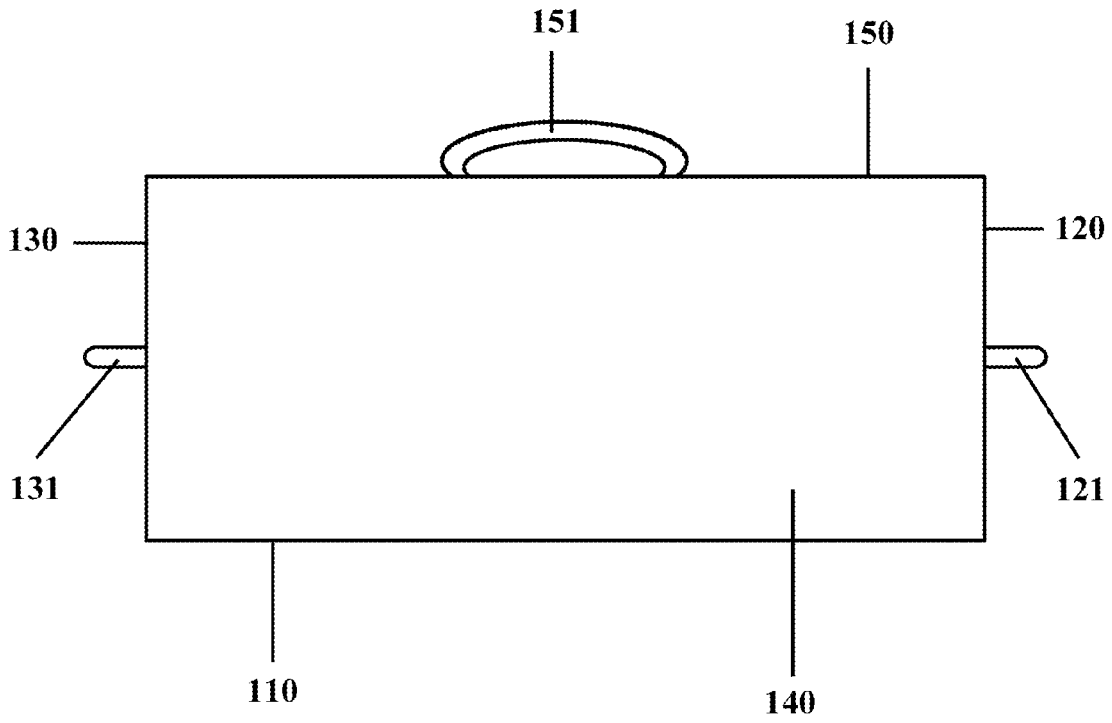
FIG. 3 is a top view of the martial arts training device without any accessories attached.

FIG. 3 is a top plan view of the top, upwards-facing surface 140, which, in this embodiment, has a rectangular profile. The longer edges of the top surface 140 are the front surface 110 edge and rear surface 150 edge, which approximates the shoulder-width of a medium-sized opponent. The length of both flanks/sides 120, 130, for example, are each up to about 30% of the length of the front and back edges. A horizontal handle 151 is attached to the upper area of the rear surface 150. The two vertical handles 121, 131 are visible as attached to the two flank surfaces 120, 130. Opposite the rear surface 150 is the front surface 110, with no accessories attached in this example.

Figure 4:
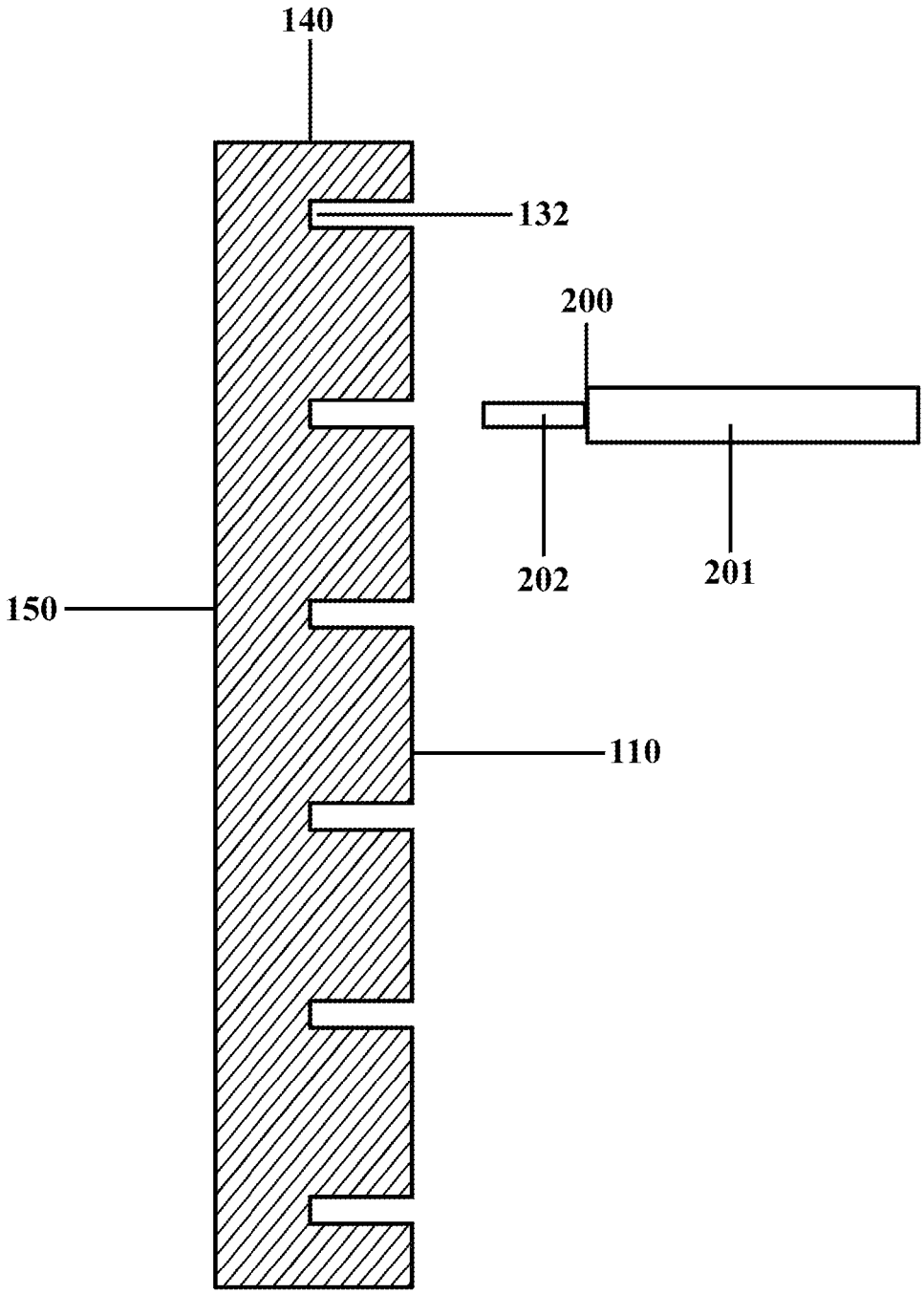
FIG. 4 is a side and cross-sectional view of the martial arts training device depicting the depth of the accessory apertures as well as a side view of an arm accessory prior to attachment.

FIG. 4 is a side cross-sectional view showing the top-surface 140 oriented as facing the ceiling and upright, and the cross-sectional depth of the accessory aperture 132 as opening from the front surface 110, and terminating before breaching the rear surface 150. An arm accessory 200 is shown in a pre-attachment orientation vis-à-vis an accessory aperture 132, delineating the prospective fit of the arm accessory's attachment section 202 and the orientation of the training section 201. There may, alternatively, be apertures that continue in depth that connect through the rear side 150.

Figure 5A:
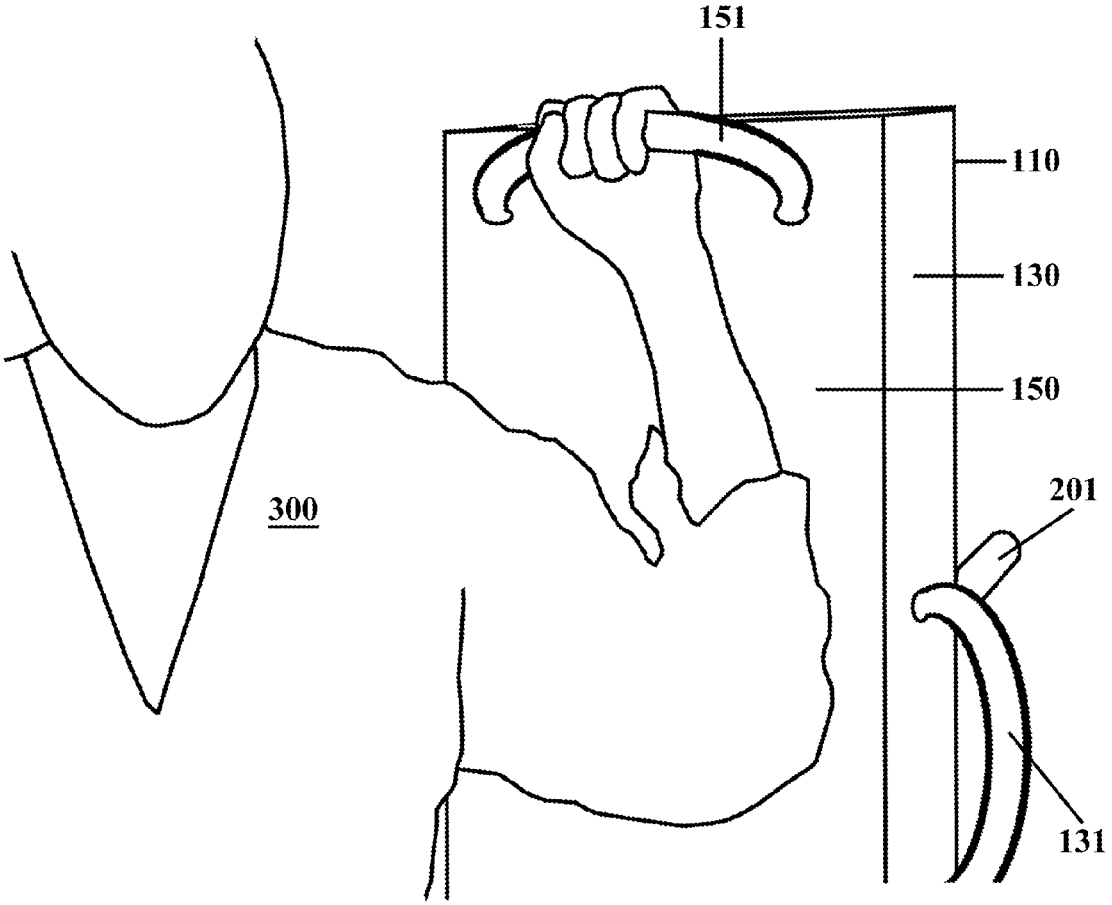
FIG. 5A is fragmented view of a training partner holding the martial arts training device with a one-hand grip utilizing one of the rear-side horizontal handles.

FIG. 5A is a fragmented rear view of a training partner 300 using a one-hand grip on the upper horizontal handle 151 which is attached to the upper portion of the rear surface 150. The visible vertical handle 131 attached to the visible flank surface 130 is not gripped. One arm accessory's training section 201 is visible as protruding from the front surface 110.

Figure 5B:
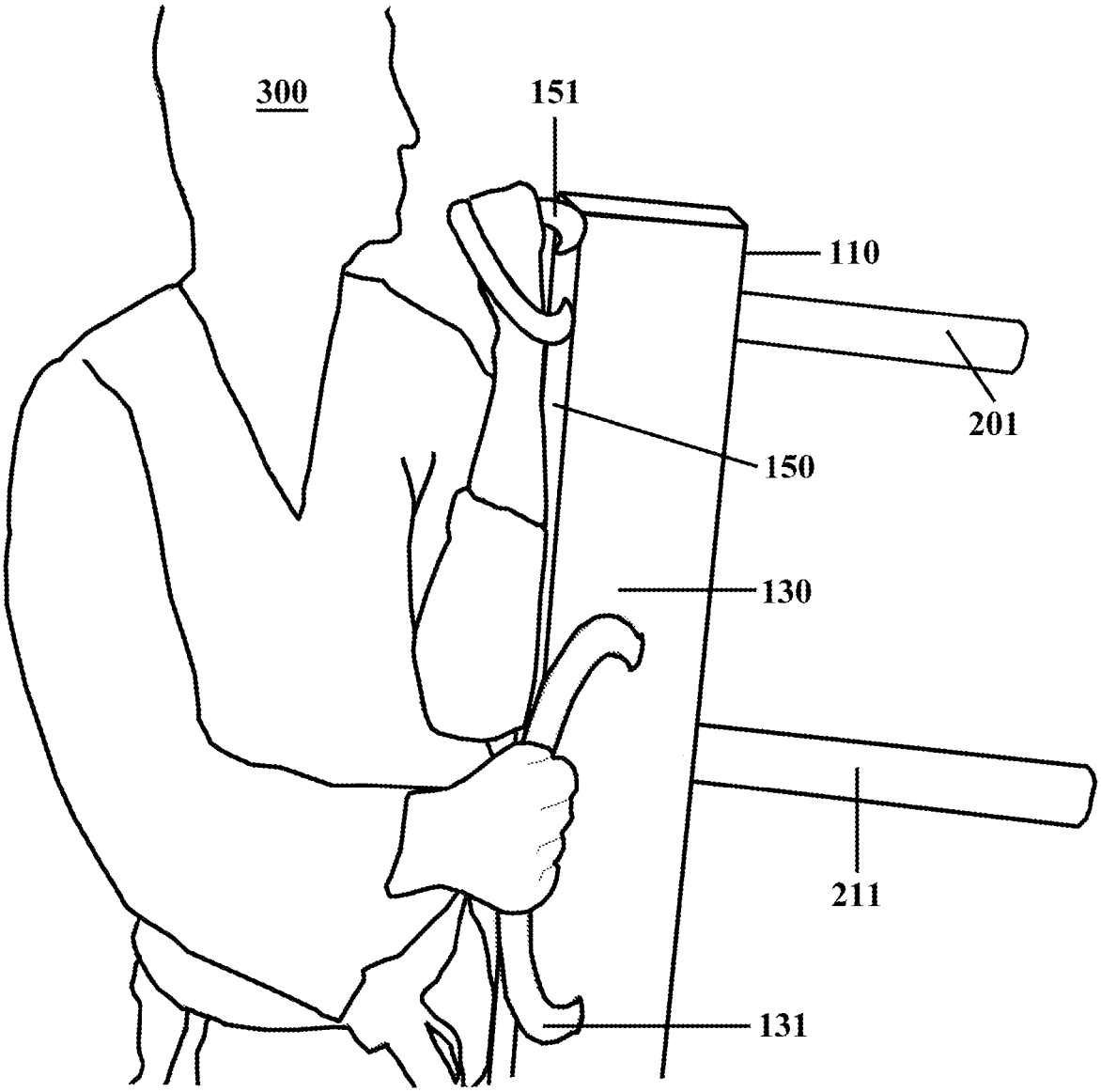
FIG. 5B is a fragmented, side perspective view of the martial arts training device being held by a training partner with a two-hand grip utilizing one of the rear-side horizontal handles and one of the vertical flank-side handles.

FIG. 5B is a fragmented view of an alternative grip in which the training partner 300 is using one hand to grip the rear surface's 150 upper horizontal handle 151 and the other hand to grip the vertical handle 131, which is attached to a visible flank side 130. The training partner 300 holds the rear surface 150 flush against his upper arm and waist for stability. The front surface 110 and two attached arm accessories' training sections 201, 211, protrude away from the training partner 300.

Figure 6A:
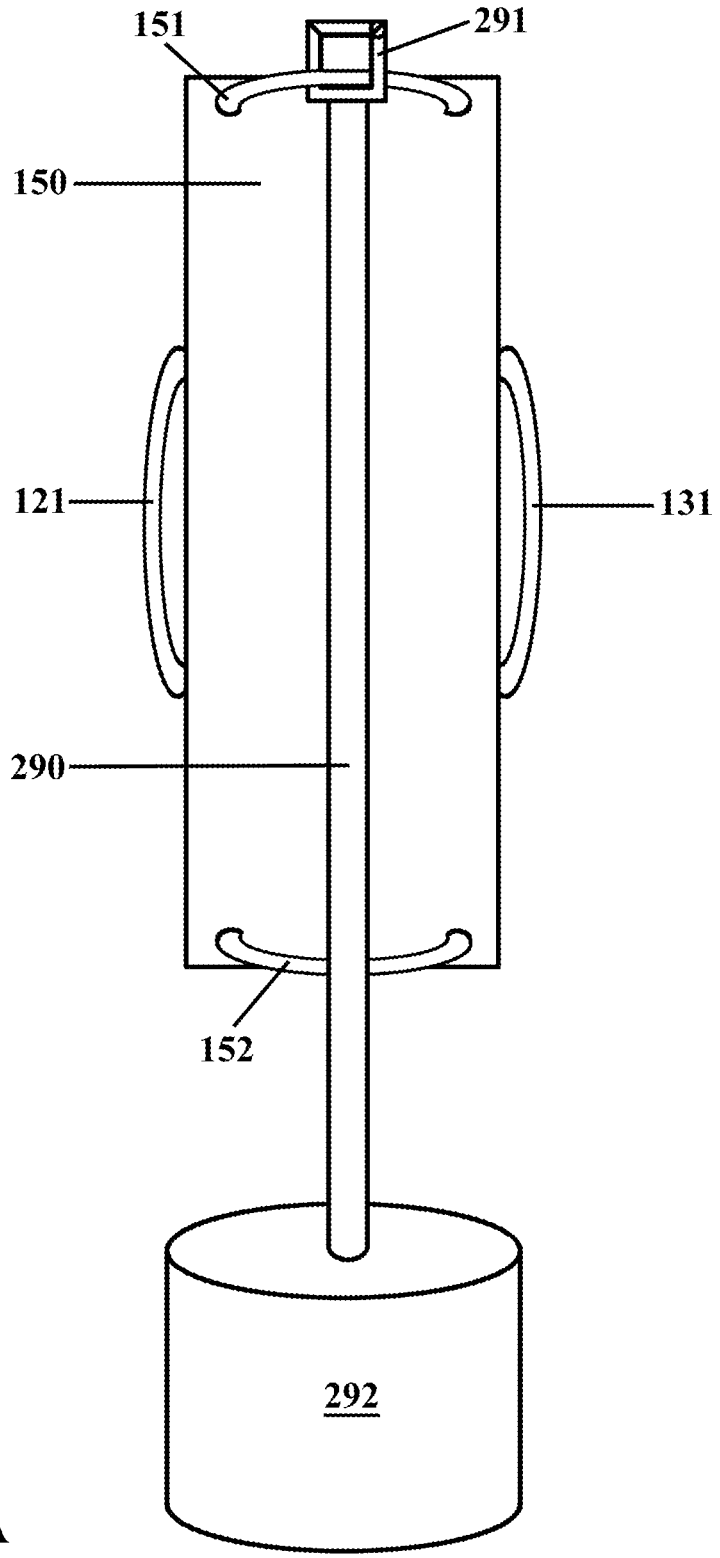
FIG. 6A is a rear perspective view showing the martial arts training device mounted by one of its rear-side horizontal handles on a stand for use as a static training device by a solo practitioner. The martial arts training device, in this embodiment, is mounted with a vertical orientation to simulate the general size and shape of an opponent's torso.

FIG. 6A is a level view of the rear surface 150 of the martial arts training device as it is mounted by the upper horizontal handle 151 on the hook/bracket head 291 of a stand 290. The rear surface profile may be the same as the front surface profile. The stand, in this example, has a weighted base 292 which may be filled with sand, water, or other appropriate ballast for stability. The two vertical handles 121, 131, as well as the lower horizontal handle 152, are not used while the device is attached to the stand. The device may also be similarly wall-mounted on a hook or bracket for solo use when a training partner is unavailable.

Figure 6B:
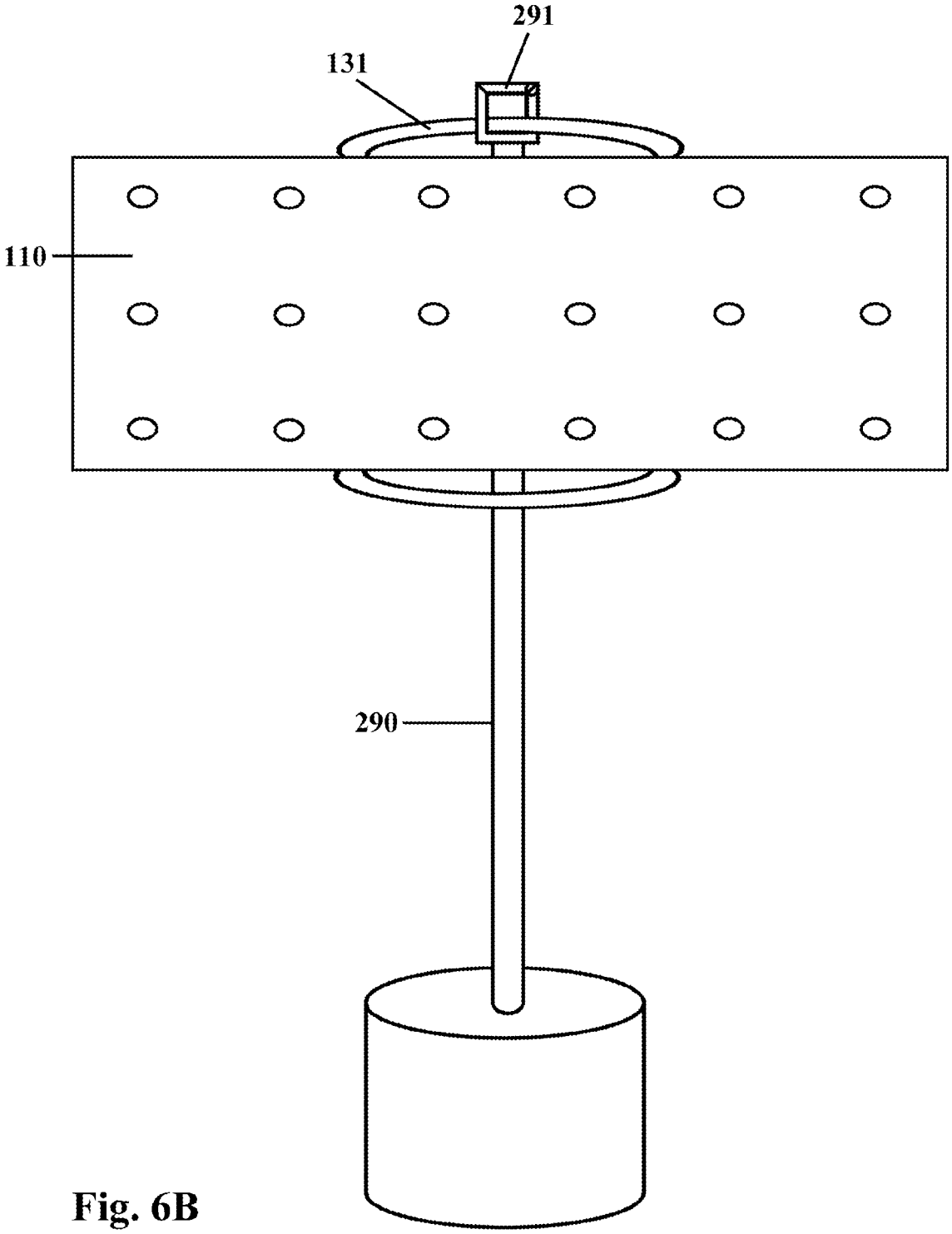
FIG. 6B is a level, frontal view of the martial arts training device mounted by one of its flank-side vertical handles on a stand in an alternative horizontal orientation for training in strafing attacks and lateral defenses techniques.

FIG. 6B is a level view of the front surface 110 with an alternative, horizontal mounting orientation for this martial arts training device, in this example, mounted on a stand 290, prior to accessory/ies attachment. One of the flank surface handles 131 serves as the device's mounting point vis-à-vis the stand's mounting head 291. This alternative orientation, whether in a solo or partnered session, allows for enhanced training in strafing attacks (such as chain-kicking), lateral defenses (such as side-shuffling footwork), and engaging simulated multiple opponents.

Figure 7:
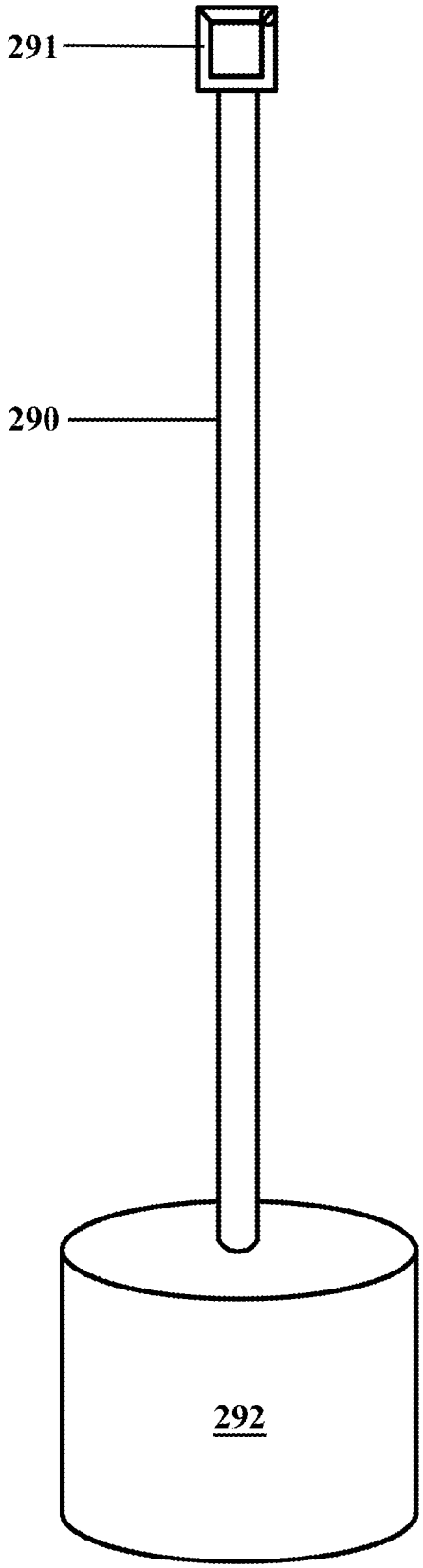
FIG. 7 is a perspective view of a stand for the martial arts training device with a mounting head and weighted base.

FIG. 7 is a view of the stand 290, by itself, for holding the martial arts training device during solo training without a partner. As noted above, the stand 290 has a hook/bracket head 291 to which the martial arts training device can be mounted by any one of its horizontal or vertical handles (121, 131, 151, or 152, not pictured). The stand 290 may have a weighted base 292 to provide stability while the device is in use.

Figure 8A:
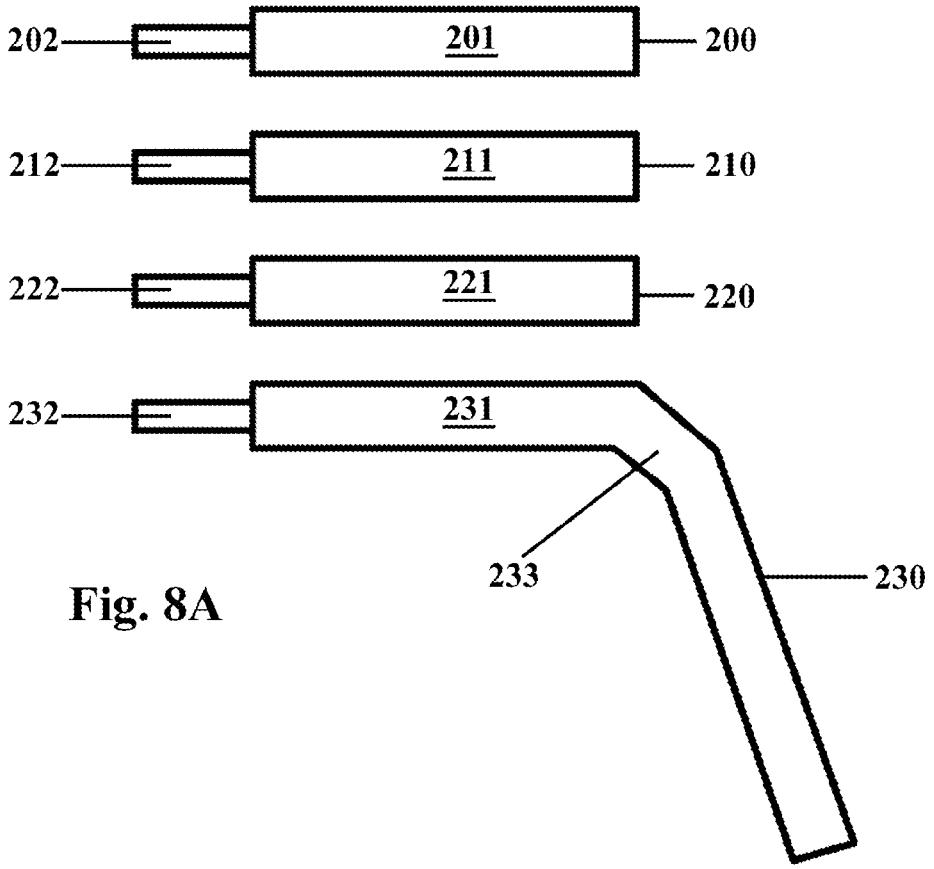
FIG. 8A shows the basic accessory package of three arms and one leg for attachment in traditional and custom configurations.

FIG. 8A depicts accessories for use with the martial arts training device. A basic training package may include three arm accessories 200, 210, and 220, each having attachment sections 202, 212, and 222 and training sections 201, 211, and 221. In this embodiment, the training sections of the arm accessories 201, 211, and 221, simulate at least the length of an opponent's forearm. The basic training package also includes a leg accessory 230, which has an attachment section 232 and a training section 231. The training section of the leg accessory 230 approximates an opponent's thigh and calf length, which, in this embodiment, is bent at a knee-like juncture 233, here, at an angle of approximately 135 degrees. All accessories' attachment sections are of sufficient length and diameter to be snugly inserted into the accessory apertures so that the training section will protrude at the desired angle, e.g., approximately perpendicular to the front surface 110 of the device (here, not pictured). The pliable material of the attachment section allows for some expansion once inserted into the aperture to create a stable and secure attachment.

Figure 16:
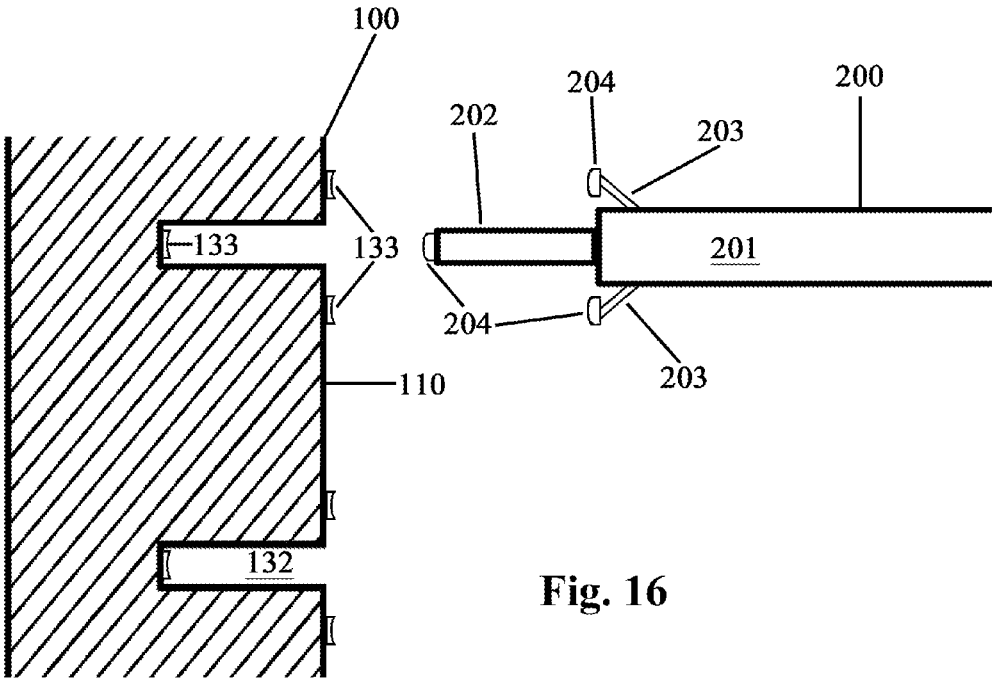
FIG. 16 is a level side view of an example of additional anchoring components, such as hook-and-loop fasteners, snap-on-clips, etc., on a fragmented arm accessory's attachment section's tip and with flexible straps, vis-à-vis a fragmented side, cross-sectional view of a base unit with corresponding anchoring components.

In this embodiment, as stated above, the accessories may be solid and fabricated of a soft, but shape-preserving material such as polyurethane foam or EVA, to withstand training contact, reduce potential of contact-related injury, and to maintain the device's partner-friendly light weight and portability. Alternatively, the accessories may be formed of plastic or metal, and may be hollow, or may be formed of wood, where more solidly-constructed accessories may be appropriate to practitioners of advanced skill levels. This basic training package accessories, jointly or severally, can be attached onto the martial arts training device to create a multitude of configurations, from configurations similar to traditional arrays, such as the Wing Chun Kung Fu Wooden Dummy, to various custom and novel opponent simulations limited only by the practitioner's imagination. Other features, such as additional accessory anchoring are possible, as shown in FIG. 16.

Figure 8B:
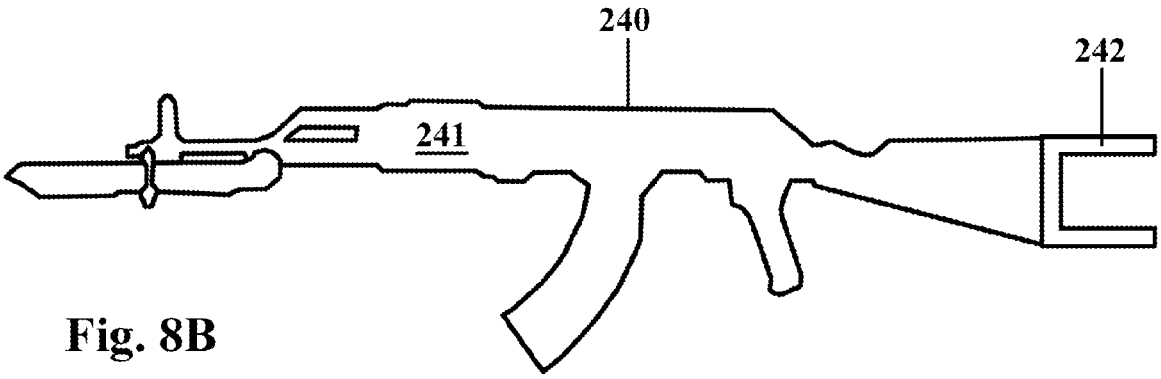
FIG. 8B shows a simulated enemy rifle-and-bayonet accessory for use in military hand-to-hand melee training.

FIG. 8B depicts a simulated enemy weapon accessory 240, for military training purposes, consisting of a simulated enemy assault rifle and bayonet combination 241, and an attachment section 242 consisting of one or more (here, two) prongs for stability. The simulated weapon is of a 1:1 scale and fabricated from soft, but form-preserving, material such as EVA or polyurethane foam, or it may be formed of other materials, such as hollow or solid plastic. The accessory 240 is lightweight enough for partnered training, provides a realistic look during training, and allows the rifleman to engage with full contact, while reducing the risk of contact injury during training.

Figure 8C:
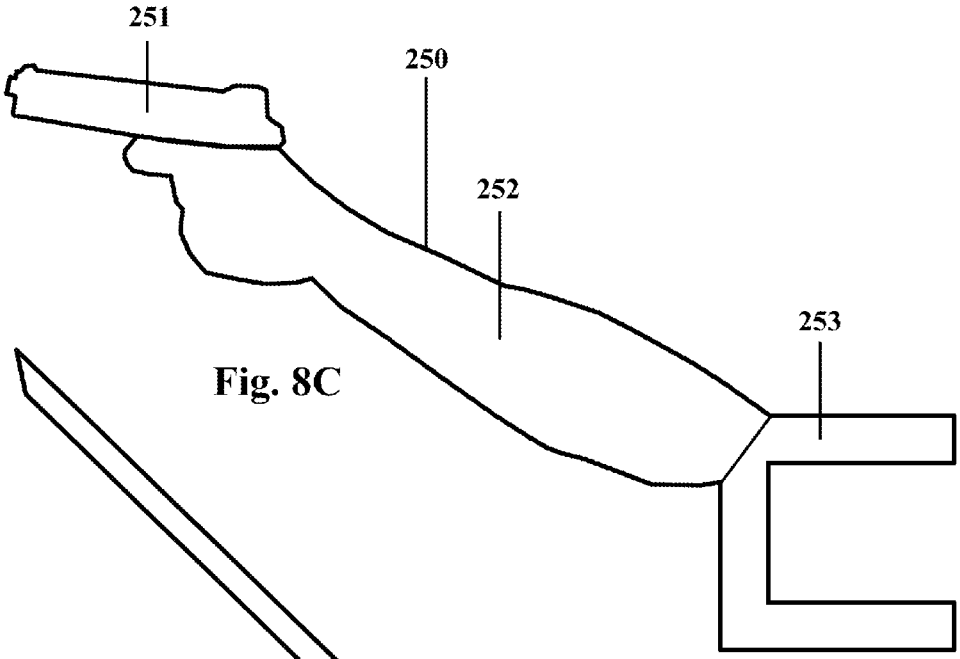
FIG. 8C shows a simulated armed suspect accessory for use in law enforcement suspect subdual and apprehension training.

FIG. 8C depicts a simulated armed suspect accessory 250 for law enforcement training purposes, which includes a simulated handgun 251, a simulated suspect's forearm 252 which "wields" the handgun 251, and an attachment section 253 consisting of one or more (here, two) prongs for stability. The simulated suspect arm and handgun are of a 1:1 scale and fabricated from soft, but form-preserving, material such as EVA or polyurethane foam, or it may be formed of other materials, such as hollow or solid plastic (e.g., the arm may be formed of foam and the gun may be formed of plastic). The accessory 250 is lightweight enough for partnered training, provides a realistic look during training, and allows the officer to engage with full contact, while reducing the risk of contact injury during training.

Figure 8D:
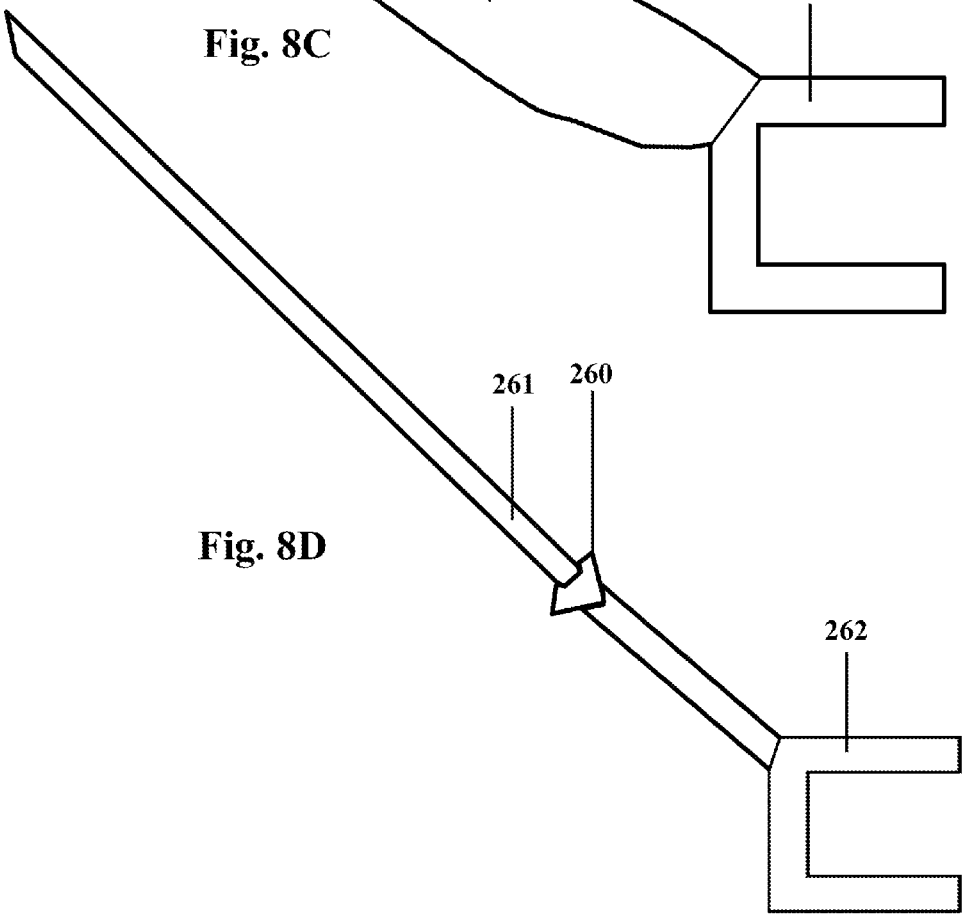
FIG. 8D shows a simulated sword for use in martial arts weapons training.

FIG. 8D depicts a simulated sword accessory 260, for martial arts weapons training, including a simulated sword training section 261 and an attachment section 262 consisting of one or more (here, two) prongs for stability. In this embodiment, the sword section extends upward at, for example, approximately 30 degrees to 60 degrees relative to the attachment section (i.e., relative to horizontal) to offer a weapon position that can mimic both a defensive "guard" position, or simulate a variety of sword strikes. The simulated sword accessory 260 is of a 1:1 scale and fabricated from soft, but form-preserving material such as EVA or polyurethane foam, or it may be formed of other materials, such as hollow or solid plastic. The accessory is lightweight enough for partnered training, provides a realistic look during training, and allows the armed or unarmed martial artist to engage with full contact, while reducing the risk of contact injury during training. Besides, swords, other martial arts and melee weapons accessories, such as clubs, knives, baseball bats, etc., can be similarly structured and constructed.

Figure 8E:
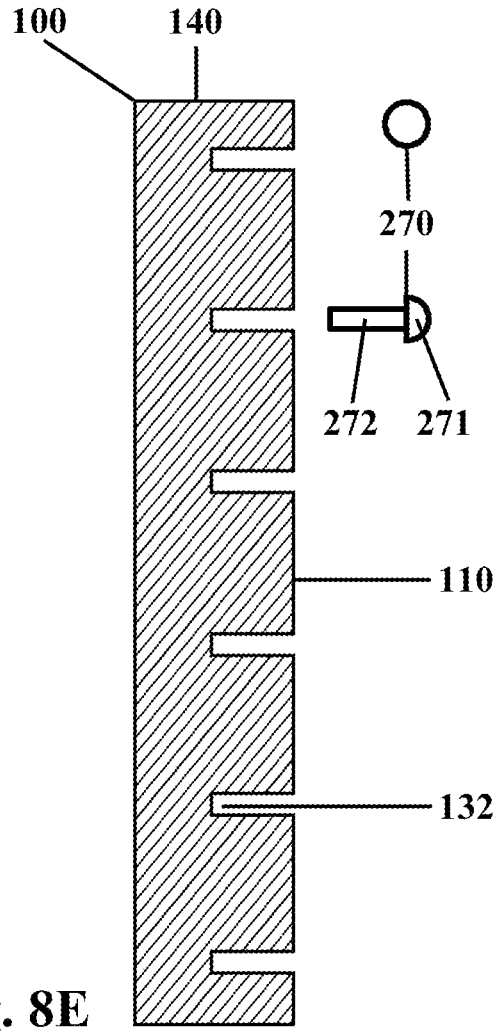
FIG. 8E is a side and frontal view of an aperture targeting plug accessory, vis-à-vis a side, cross-sectional view of the martial arts training device, prior to installation of the plug into a receiving aperture.
Figure 8F:
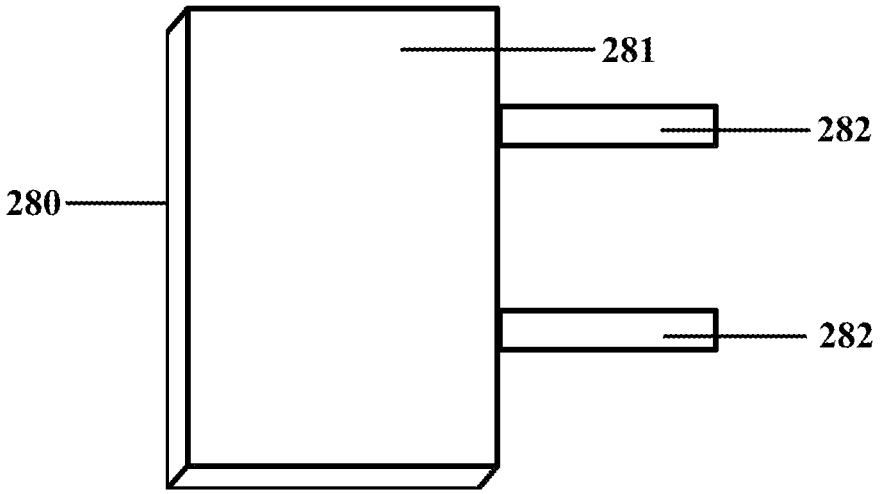
FIG. 8F is a front perspective view of a targeting pad accessory that creates additional targeting area and striking vectors when attached.

FIG. 8E depicts two targeting plug accessories 270 (one from a top view and one from a side view of the targeting plug), which has an attachment section 272 and a target section 271. The side-view targeting plug 270 is shown oriented toward a cross-sectional-view accessory aperture 132 of the front surface 110 of the body 100 of the martial arts training device (which is shown as a side cross-sectional view, with its top side 140 in an upright orientation) to illustrate how the targeting plug 270 is installed by insertion into the aperture 132. The targeting plugs can be installed in unused apertures to provide additional targeting surfaces where there would otherwise be empty, unused apertures. The diameter of the targeting section of the targeting plug 270 is large enough to extend beyond the aperture's circumference, onto the front surface 110, but is small enough so that it does not come into contact with any adjacent targeting plugs or accessories. The targeting plug 270 is fabricated from soft, but form-preserving, material such as EVA or polyurethane foam, or may be formed of other materials, such as hollow or solid plastic. The targeting plug 270 is lightweight enough for partnered training and allows the practitioner to engage with full contact, while reducing the risk of contact injury during training FIG. 8F depicts a targeting pad 280, which has a striking surface 281 and at least one attachment section 282 (in this example, there are two). In this embodiment, the twin attachment sections 282, are of sufficient length to allow the targeting pad 280 to be attached to, but not touch, the front surface 110 of the device. The targeting pad 280 may have a rectangular profile which, for example, approximates the width and length of an opponent's head. The targeting pad 280 is fabricated from soft, but form-preserving, material such as EVA or polyurethane foam, or may be formed of other materials, such as hollow or solid plastic. The targeting pad 280 is lightweight enough for partnered training, offers additional striking vectors (because it is perpendicular to the front surface 110), and allows the practitioner to engage with full contact, while reducing the risk of contact injury during training. Alternate versions of a targeting pad may vary in shape, size, and attachment section configuration.

Figure 9:
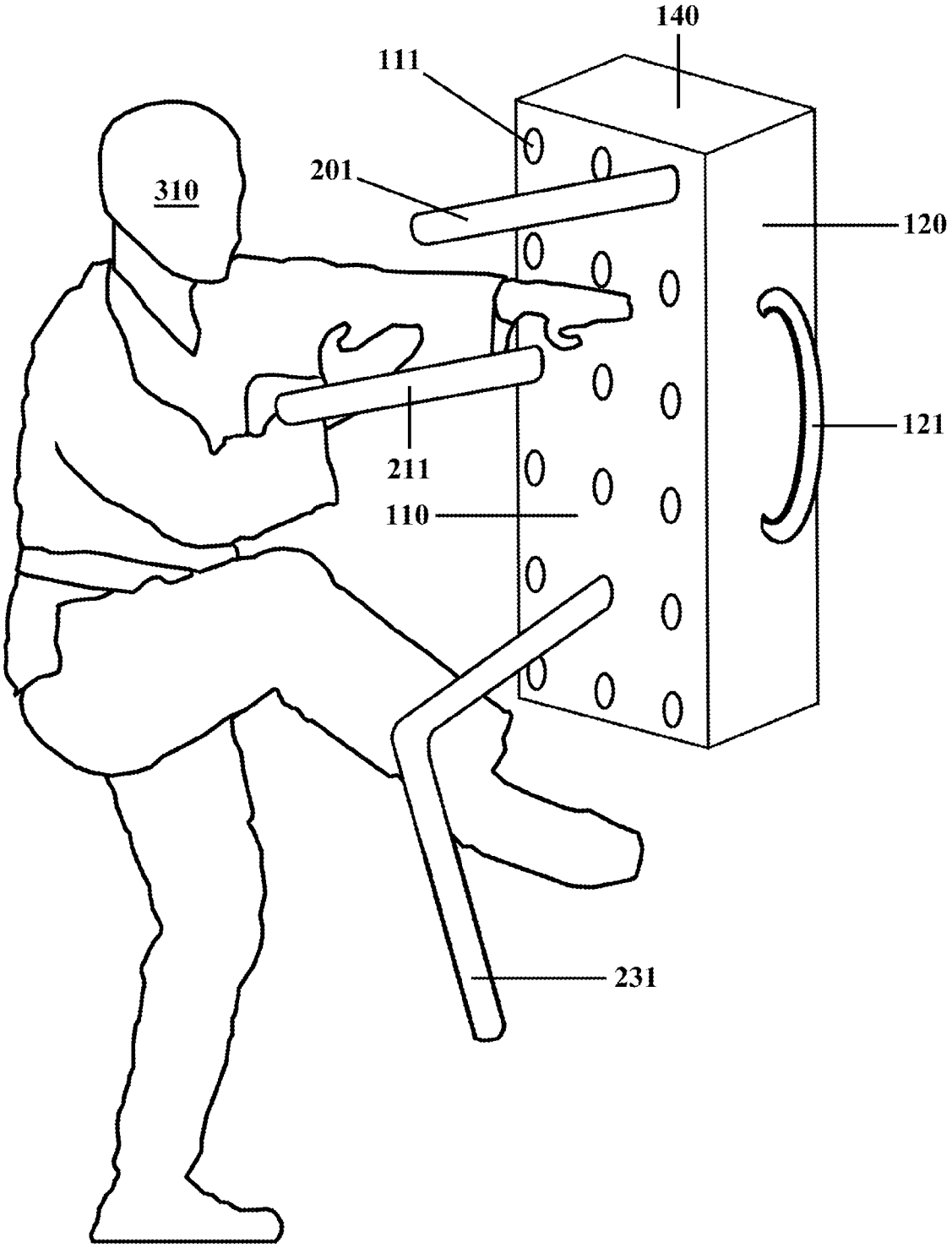
FIG. 9 is a perspective view of the martial arts training device mounted on a wall, with a two-arm and one-leg custom variant of a wooden dummy configuration being used by a solo martial arts practitioner as a static training device. The solo practitioner is executing a simultaneous offensive hand strike and hand-and-leg defensive parrying/blocking technique.

FIG. 9 depicts an unarmed martial artist 310 engaging in solo training with a wall-mounted (via the rear, upper horizontal handle 151, not visible here), static version of the martial arts training device. Here, the visible vertical side handle 121 on flank side 120 is not in use, and the device is oriented with the top side 140 upright and the front side 110 facing the practitioner. In this embodiment, two opponent's arms are simulated by the protruding training sections 201, 211, representing incoming attacks to the practitioner's left-midsection (i.e., training section 201), and right-side of head (i.e., training section 211). The protruding training section 231 of the leg attachment simulates an incoming, low centerline attack, such as a low front kick. Other unused accessory apertures 111 are visible. During the training, the martial artist 310 can parry the simulated leg 231 with his own leg, while blocking the simulated lower arm 211 with his arm and delivering a precision hand chop below the simulated upper arm 201. As a mounted, static apparatus, the martial arts training device can replicate the configuration of a traditional Wing Chung Kung Fu Wooden Dummy and any range of desired custom configurations, whereas a traditional Wing Chung Kung Fu Wooden Dummy is not adaptable and only has a single, unalterable configuration.

Figure 10A:
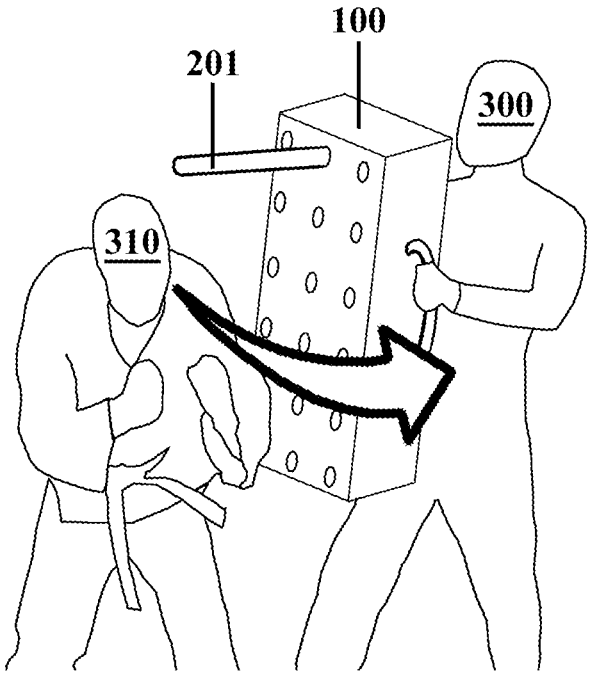
FIG. 10A is a perspective view of the martial arts training device being used in a partnered training session for traditional martial arts practice where the holding partner is using a single arm-accessory configuration to simulate a side vectoring-attack for the practitioner to evade and duck under.

FIG. 10A depicts a partnered, unarmed martial arts training sequence in which the training partner 300 holds the device body 100, which is configured with one protruding arm-accessory's training section 201. During this training sequence, the training partner 300 swings the training section 201 in a horizontal vector at the martial artist 310, who evades the simulated attack by bobbing and weaving under the accessory's lateral arc.

Figure 10B:
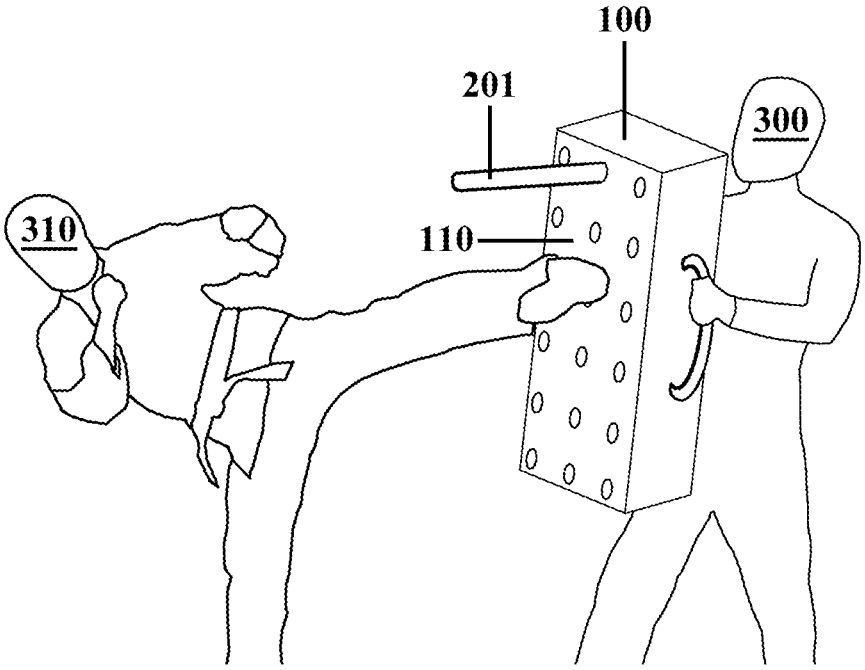
FIG. 10B is an additional perspective view of the martial arts training device of FIG. 10A being used in a training session in which the practitioner, upon ducking under the arm accessory, then counter-attacks with a sidekick to the device's primary targeting surface.

FIG. 10B depicts a partnered, unarmed martial arts training sequence in which the training partner 300 holds the device body 100, which is configured with one protruding arm-accessory's training section 201. The martial artist 310, having previously evaded a simulated blow in the training sequence of FIG. 10A, can now counterattack by launching a sidekick to the front surface 110 of the device body 100. This unarmed martial arts "defense-then-counterattack" sequence (i.e., bob and weave, then sidekick) utilizing the martial arts training device can also be reversed as an "attack-then-defense" sequence (i.e., sidekick, then bob and weave). Thus, the martial arts training device allows for flexible, full-spectrum training.

Figure 11A:
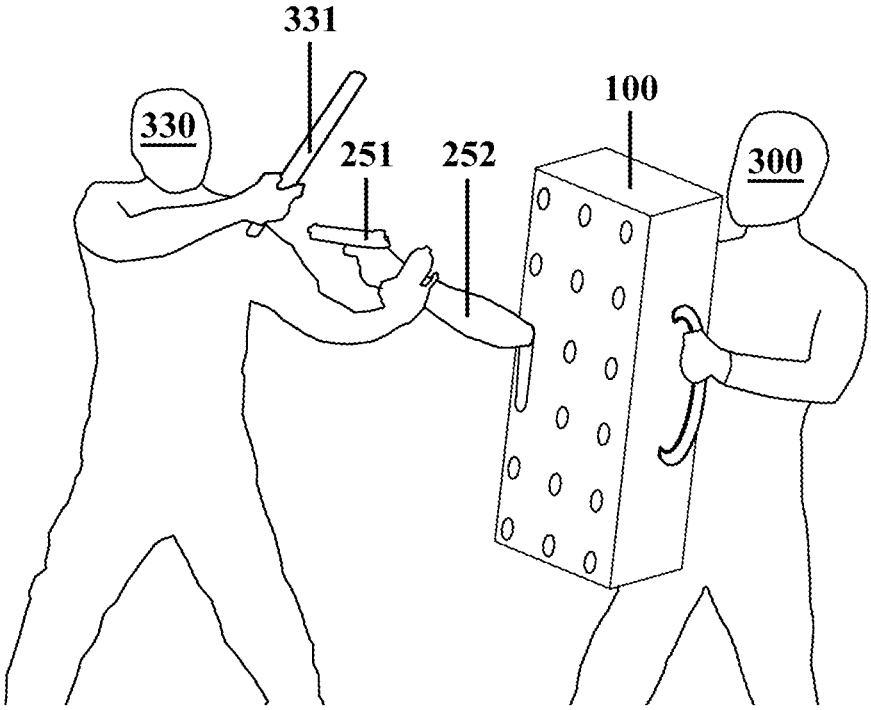
FIG. 11A is a perspective view of the martial arts training device being used in a partnered training session for law enforcement techniques practice where the holding partner is using a simulated-armed-suspect accessory configuration for the practitioner to practice suspect subdual techniques utilizing a police baton.

FIG. 11A depicts a law enforcement training sequence in which the training partner 300 holds the device 100, which is configured with an accessory simulating a suspect's arm 252 wielding a handgun 251. In this example, the law enforcement officer 330 parries the suspect's arm 252 away and responds with a riot baton 331 to subdue the suspect.

Figure 11B:
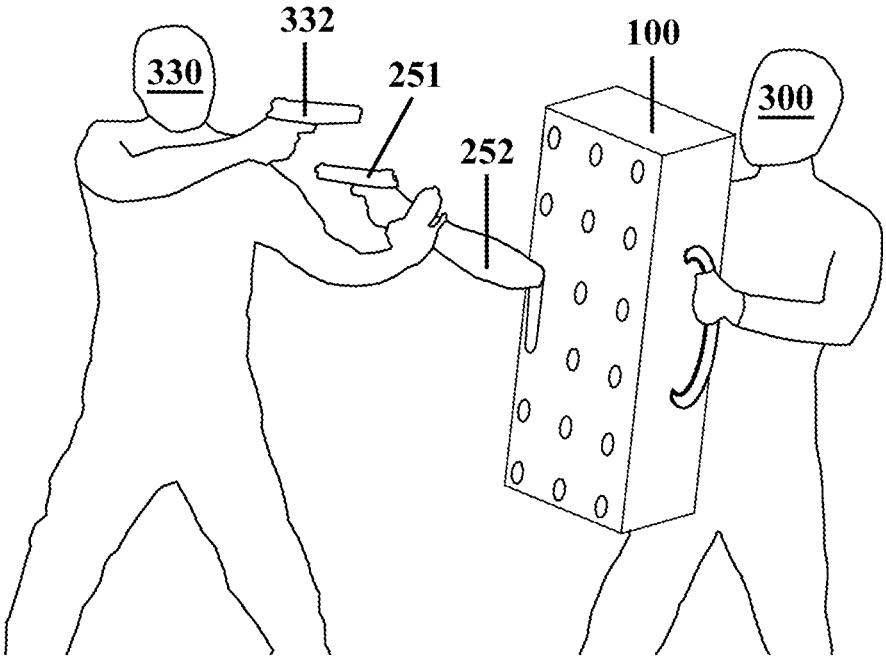
FIG. 11B is an additional view of the martial arts training device of FIG. 11A being used in a partnered training session for law enforcement training in which, upon subduing the simulated-armed-suspect, the officer proceeds to quick-draw and utilize his service pistol for suspect apprehension.

FIG. 11B depicts a law enforcement training sequence in which the training partner 300 holds the device body 100, which is configured with an accessory simulating a suspect's arm 252 wielding a handgun 251. In this example, the law enforcement officer 330, having previously (in the example of FIG. 11A) parried the suspect's arm 252 away and delivered a subduing baton strike, now quick-draws his service pistol 332 to apprehend the suspect. This law enforcement training sequence of "subduing-then-apprehending" (i.e., first employing a riot baton, then a service pistol) utilizing the martial arts training device can also be reversed as "failed-apprehending-then-subduing" in which the officer draws his pistol, simulates losing the pistol, and then deploys a secondary weapon, e.g., the baton, to bring suspect under control.

Figure 12A:
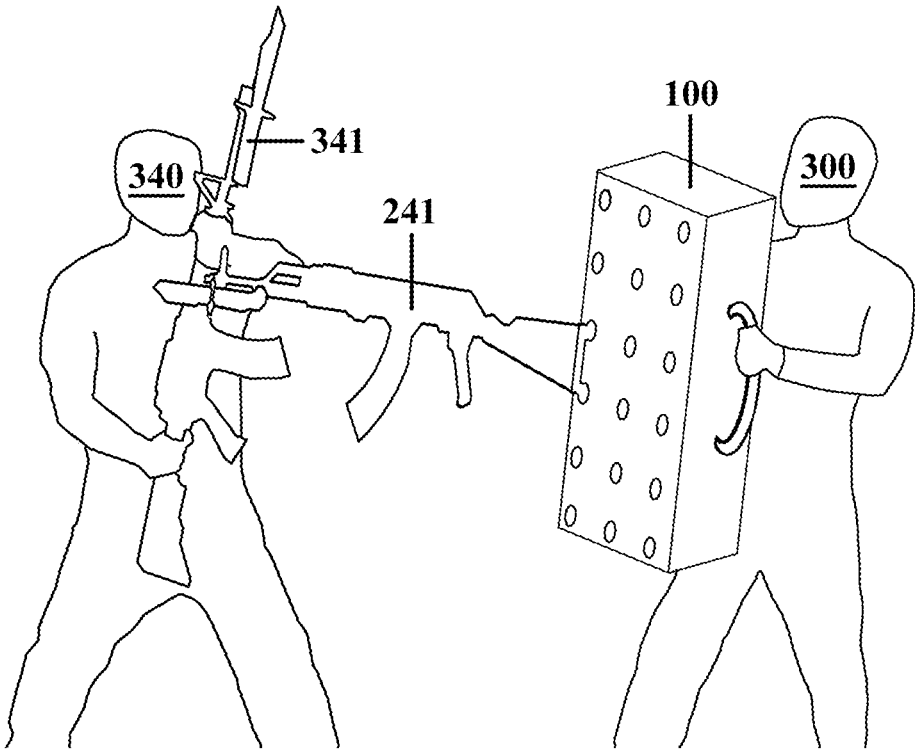
FIG. 12A is a perspective view of the martial arts training device being used in a partnered training session for military bayonet techniques where the holding partner is using a simulated enemy rifle-and-bayonet accessory configuration, and the practitioner parries the accessory with his own training rifle-and-bayonet.

FIG. 12A depicts a partnered military melee training sequence in which the training partner 300 holds the device body 100, which is configured with a simulated enemy assault rifle and bayonet accessory 241. In this example, the training partner 300 thrusts the bayonet at the infantryman 340, who blocks the simulated attack using his own assault rifle and training bayonet 341.

Figure 12B:
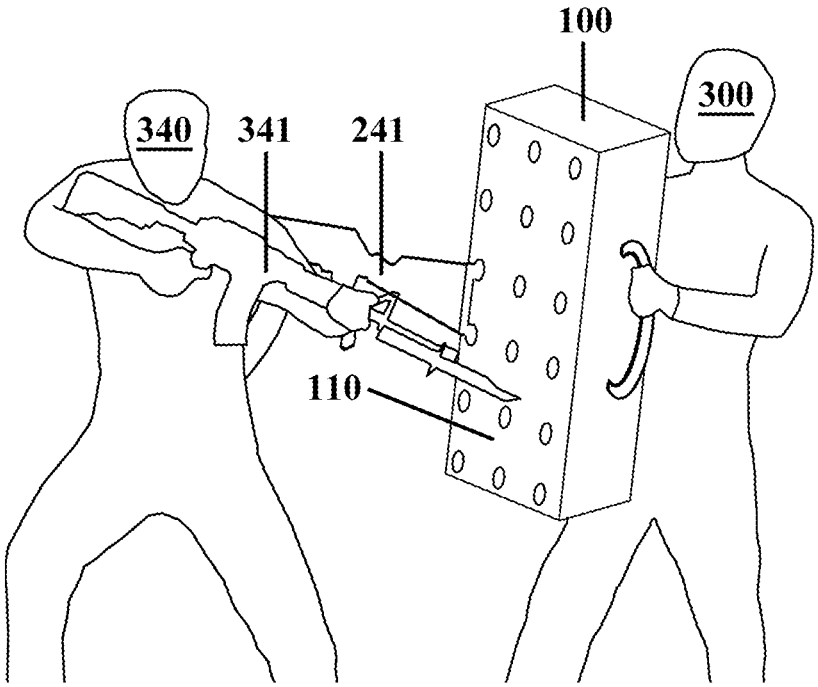
FIG. 12B is an additional view of the martial arts training device of FIG. 12A being used in a training session in which, upon parrying the enemy bayonet, the practitioner then steps to the simulated enemy's "inside" and counter-attacks with a bayonet strike to the device's primary targeting surface.

FIG. 12B depicts a partnered military melee training sequence in which the training partner 300 holds the device body 100, which is configured with a simulated enemy assault rifle and bayonet accessory 241. In this example, the infantryman 340, having previously blocked a simulated blow (in the example of FIG. 12A), now moves the enemy weapon 241 aside and launches a bayonet strike to the front surface 110 of the device using his training bayonet 341. This military bayonet "defense-then-counterattack" sequence (i.e., rifle parry, then bayonet thrust) utilizing the martial arts training device can also be reversed as an "attack-then-defense" (i.e., bayonet thrust, then rifle parry).

Figure 13A:
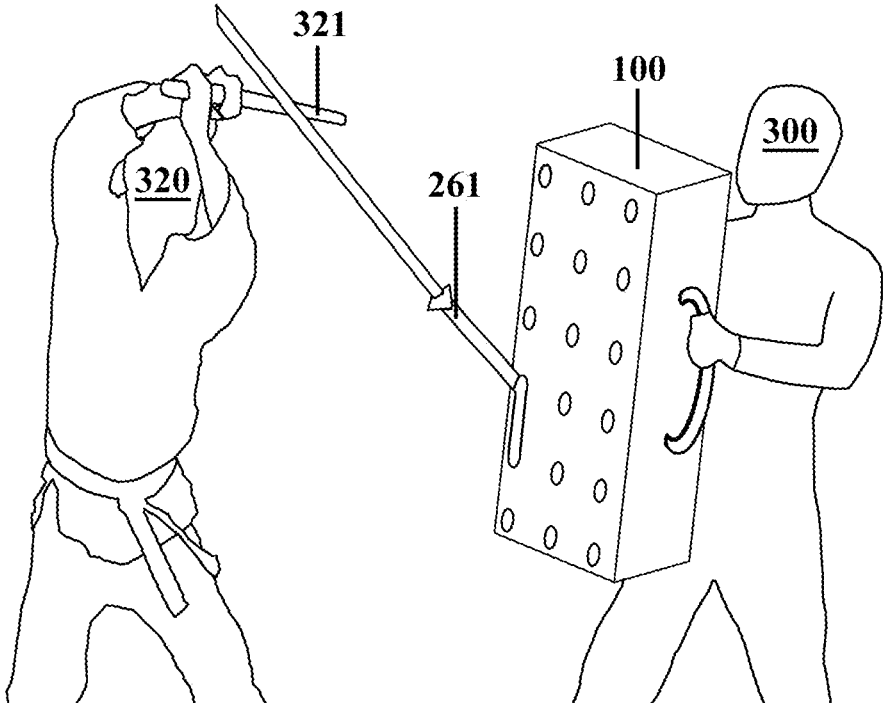
FIG. 13A is a perspective view of the martial arts training device being used in a partnered training session for traditional martial arts weapons training, here, with traditional, Kendo-style, "shinai" training swords, where the holding partner is using a simulated sword accessory configuration, and the practitioner deflects the accessory with a training sword.

FIG. 13A depicts a partnered martial arts weapon training sequence in which the training partner 300 holds the device body 100, which is configured with a simulated martial arts weapon accessory, here, sword-shaped, having a protruding training section 261. In this example, the training partner 300 executes a simulated downwards sword slash to the armed martial artist 320, who deflects the simulated attack using his training weapon, here, a sword 321.

Figure 13B:
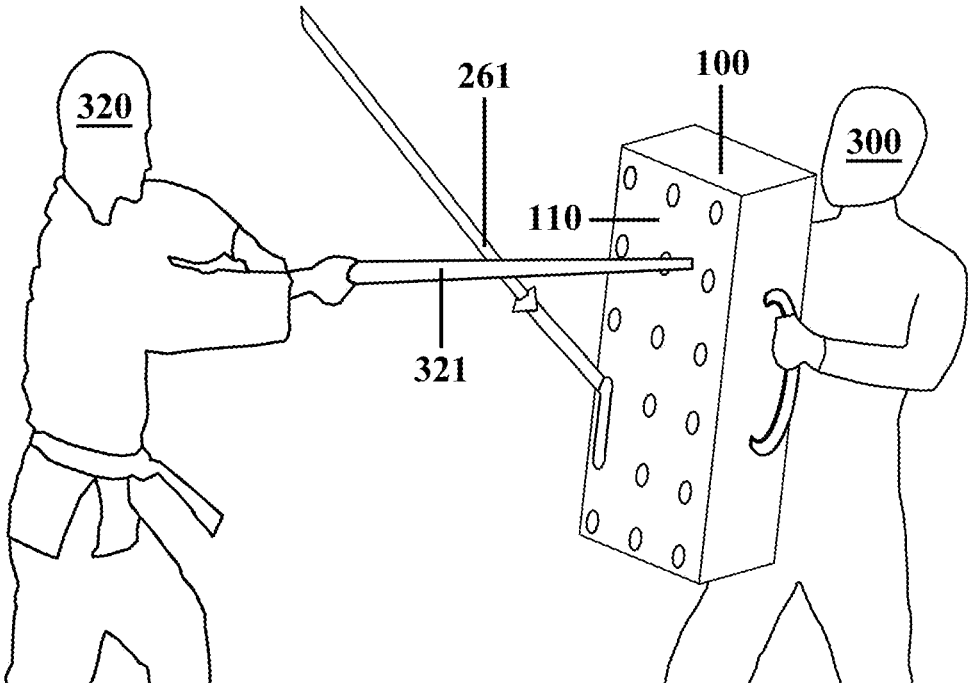
FIG. 13B is an additional view of the martial arts training device of FIG. 13A being used in a training session in which, upon parrying the simulated opponent's sword, the practitioner then counter-attacks with a sword strike to the martial arts training device's primary targeting surface.

FIG. 13B depicts a partnered martial arts weapon training sequence in which the training partner 300 holds the device body 100, which is configured with a simulated martial arts weapon accessory, here, sword-shaped, having a protruding training section 261. In this example, the armed martial artist 320 wielding a training sword 321, having previously deflected a simulated strike (in the example of FIG. 13A), now counterattacks with a sword swing to the front surface 110 of the device with his training sword 321. This martial arts weapon "defense-then-counterattack" sequence (i.e., sword deflection, then sword swing) utilizing the martial arts training device can also be reversed as an "attack-then-defense" (i.e., sword swing, then sword deflection).

Figure 14A:
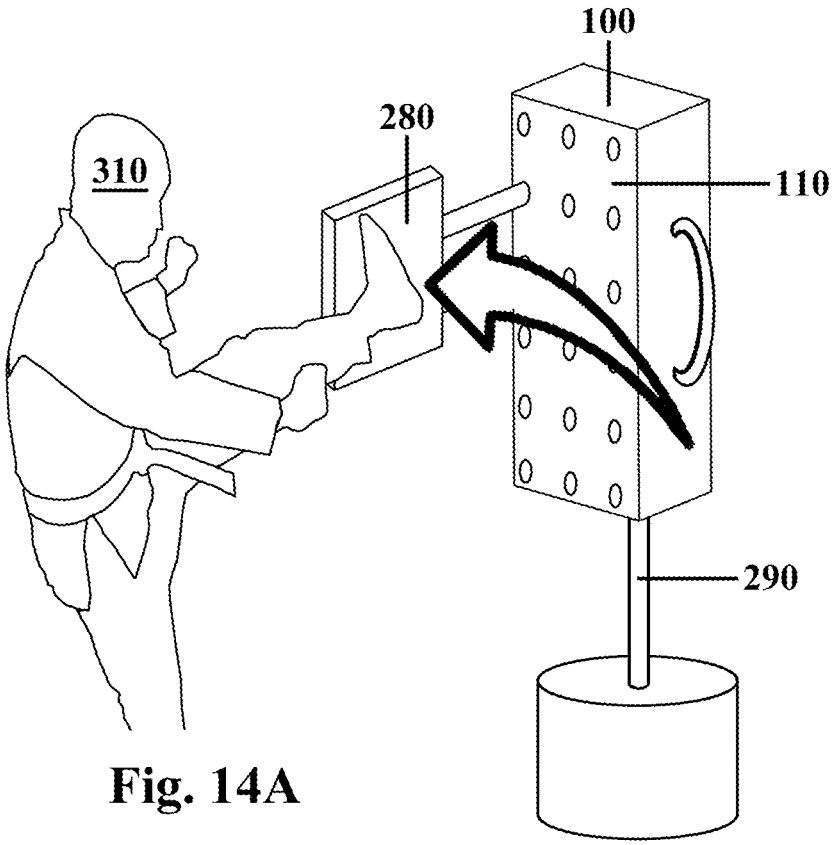
FIG. 14A is a perspective view of the martial arts training device mounted on a stand with a target pad accessory attached in a vertical orientation for a solo practitioner to train in side-vectoring strikes, e.g., a crescent kick.

FIG. 14A depicts an unarmed martial artist 310 engaging in solo training with the device body 100 mounted on a stand 290. A targeting pad 280 accessory is attached to the front surface 110 in a vertical orientation, creating an additional targeting plane appropriate for side-vectoring offensive strikes, such as, e.g., an inside-to-outside crescent kick.

Figure 14B:
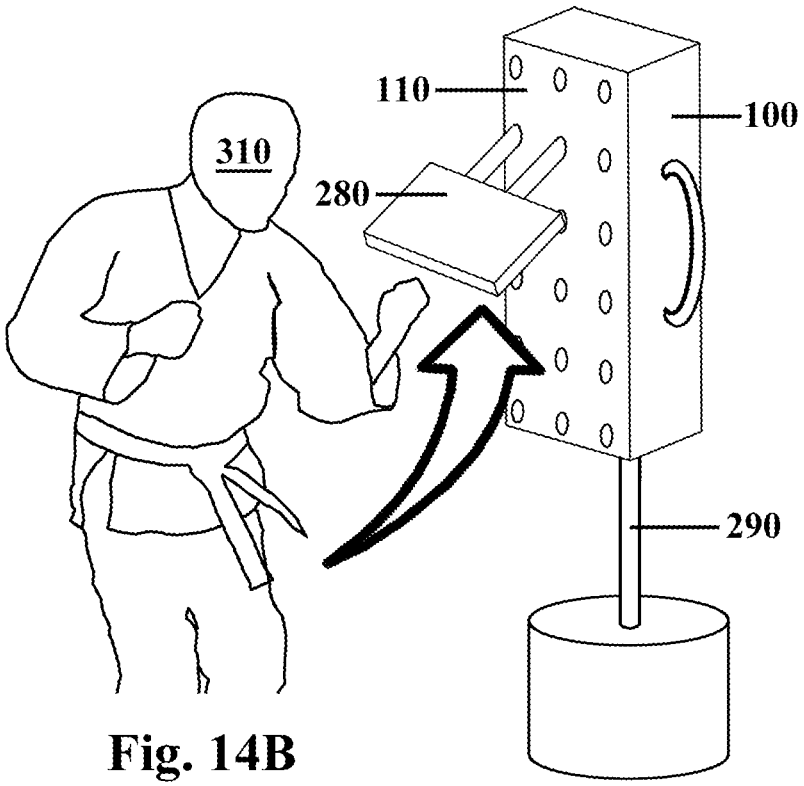
FIG. 14B is a perspective view of the martial arts training device mounted on a stand with a target pad accessory attached in a horizontal orientation for a solo practitioner to train in vertical-vectoring strikes, e.g., an uppercut punch.

FIG. 14B depicts an unarmed martial artist 310 engaging in solo training with the device body 100 mounted on a stand 290. A targeting pad 280 accessory is attached to the front surface 110 in a horizontal orientation, creating an additional targeting plane appropriate for vertical-vectoring offensive strikes, such as an uppercut punch.

Figure 15:
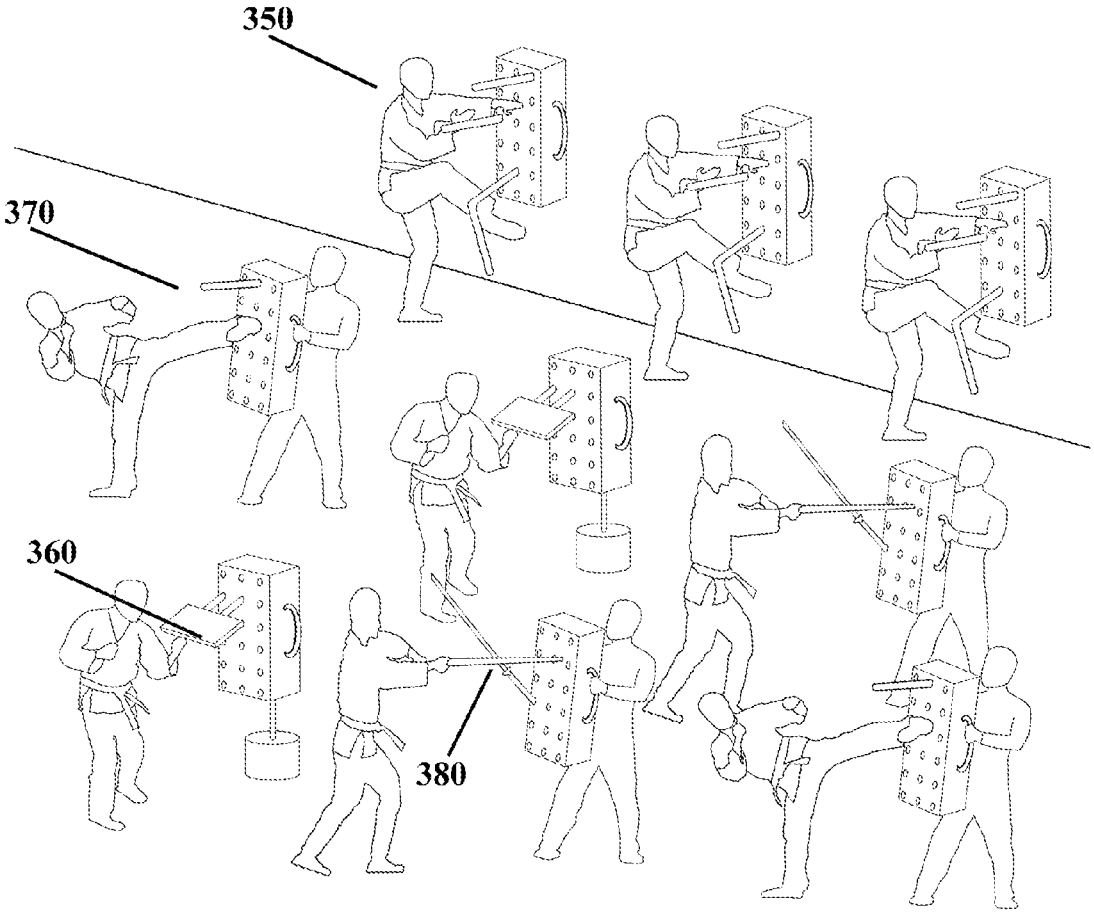
FIG. 15 is a perspective view depicting a group of practitioners' mixed use of several units of the martial arts training device in a dojo context, such as solo wall-mounted and stand-mounted use; partnered use; and training in a variety of unarmed and armed techniques. This group example illustrates the martial arts training device's versatility in a multitude of simultaneous uses.

FIG. 15 depicts simultaneous mixed-use of multiple martial arts training devices by a group of practitioners in a dojo context. The device's versatility is demonstrated by this example, as it is used in various configurations for diverse unarmed and armed training purposes, e.g., by unarmed partnered pairs 370, armed partnered pairs 380 (here, wielding practice swords), or by solo practitioners as mounted on both stands 360 and the wall 350.

FIG. 16 is a partial, side cross-sectional view of an accessory aperture 132 of the device 100 and a fragmented side view of an arm accessory 200 prior to insertion into an accessory aperture 132. Additional anchoring components may be provided to strengthen the attachment between the device and the accessory 200. In this embodiment, the anchoring components 204 are attached to the arm accessory 200, e.g., directly on the tip of its attachment section 202, and/or the ends of small flexible straps or rigid support members 203 attached to the lower part of the training section 201. The straps may be formed of various materials, such as plastic or leather, and the support members may be formed of various materials, such as metal or plastic. On a portion of the front surface 110 of the base unit 100 there are corresponding anchoring components 133 in corresponding locations near the accessory aperture 132, and there may be another anchoring component 133 affixed to the bottom of the corresponding hole of the accessory aperture 132. The anchoring components 133 may be formed, e.g., of magnets, snaps, hook-and-loop fasteners, etc.

Figure 17A:
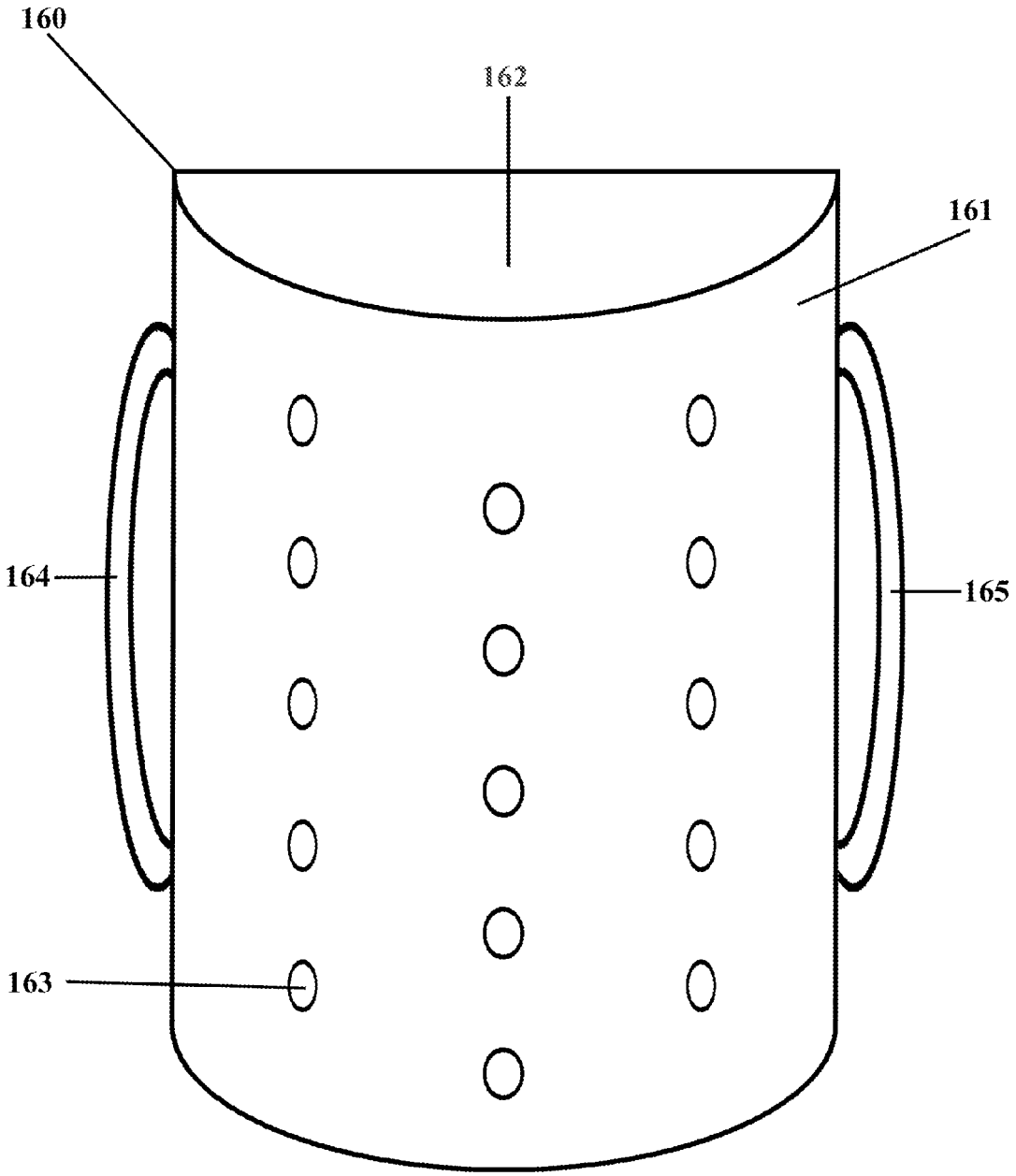
FIG. 17A is an example of an alternative shape and dimensions for the base unit. In this example, the base unit has a rectangular level frontal profile, but the thickness/girth dimension has a semicircular/demi-column profile, simulating a curved user interface, for example, similar to a heavy bag, or to the traditional Wing Chun Kung Fu Wooden Dummy.

FIG. 17A depicts the front surface 161 of a further embodiment of the martial arts training device having an alternatively-shaped base unit 160. The width and height of the frontal profile approximates the width and length of an opponent's shoulders and torso. The overhead profile, i.e., top surface 162, is approximately in the shape of a semi-circle. This alternative overhead profile simulates training specifications desirable to practitioners seeking, for example, a device with a rounded user interface closer to that the heavy bag or the traditional Wing Chun Kung Fu Wooden Dummy. The front surface 161 has accessory apertures 163, similar to those discussed above with respect to the rectangular-shaped base unit 100 (the apertures are depicted in FIG. 17A as being unoccupied). The base unit 160 may include vertical handles flank-surface handles 164, 165, and may also have a horizontally-oriented handles (not shown) on the upper and lower portions of a rear surface of the base unit 160. As shown in FIG. 17A, the front surface 161 and flank (i.e., side) surfaces in this embodiment form a single continuous, curved surface; a "side" of the body 160 is not distinctly defined by an edge or corner, as in the rectangular-shaped embodiments.

Figure 17B:
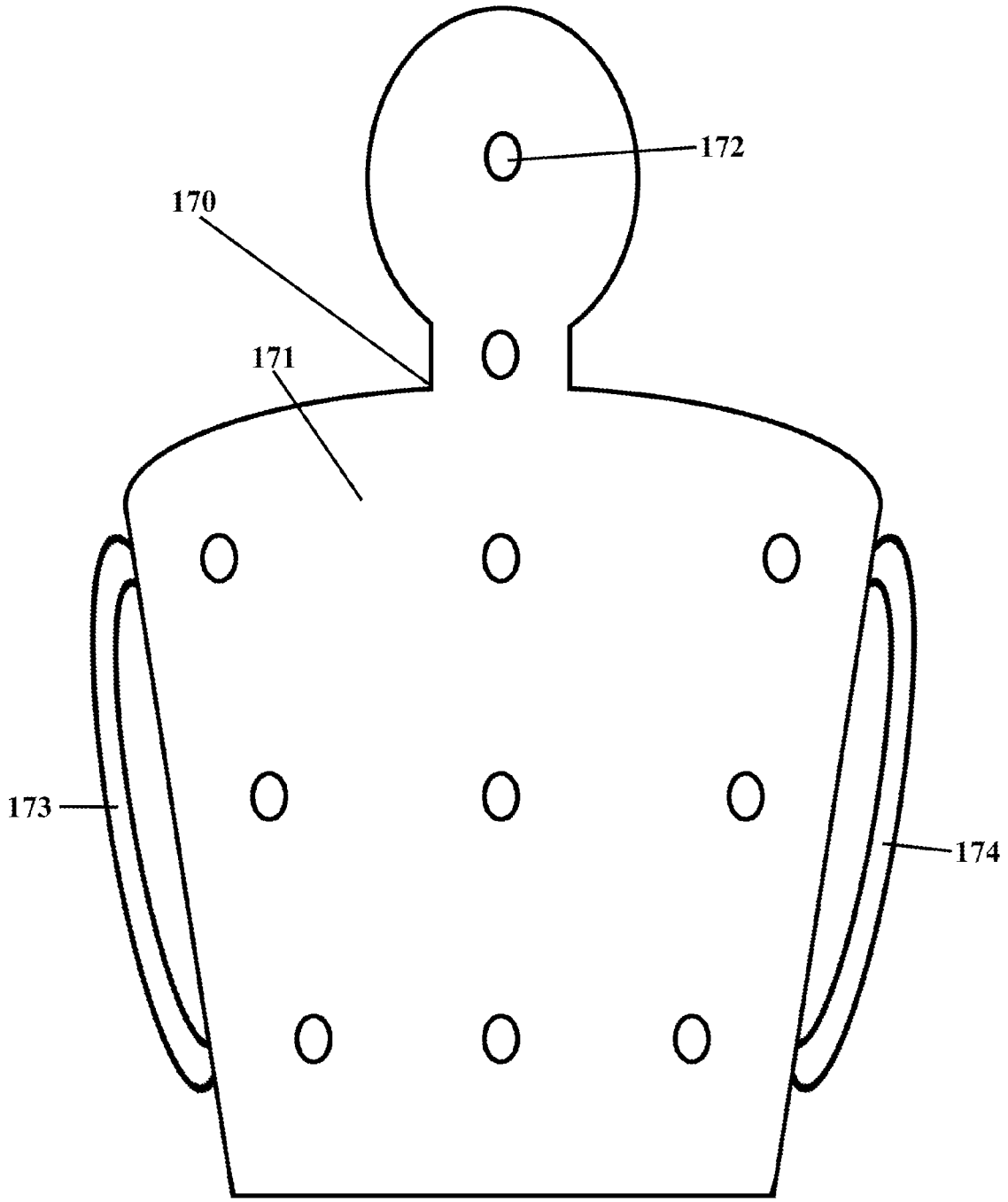
FIG. 17B is an example of an alternative shape and dimensions for the base unit. In this example, the base unit has a human-outline level frontal profile for military and/or law enforcement training, analogous to human-outline-shaped paper targets for firearms; and, FIG. 18 is a level frontal cross-sectional view of the martial arts training device which shows additional placements for apertures along the periphery of the two flank-facing, top-facing, and bottom-facing surfaces for simulating additional opponent attacks and offering additional targeting surfaces, e.g., a target pad accessory, arm accessory, and target plug accessory are placed in pre-attachment orientation with regard to the base unit.

FIG. 17B is a level view of the front surface 171 of a further embodiment of the martial arts training device having an alternatively-shaped base unit 170 which simulates the frontal profile of a human opponent, specifically, the width, height, and shape of an opponent's head, shoulders, and torso. This alternative frontal profile provides targeting specifications desirable to practitioners, such as in the military and law enforcement who are seeking, for example, a targeting surface that more closely resembles a human combatant or suspect. The front surface 171 has accessory apertures 172, similar to those discussed above with respect to the rectangular-shaped base unit 100 (the apertures are depicted in FIG. 17B as being unoccupied). The base unit 170 may include vertical flank-surface handles 173, 174, and may also have horizontally-oriented handles (not shown) on the upper and lower portions of a rear surface of the base unit 170. As shown in FIG. 17B, the front surface 171 and flank (i.e., side) surfaces in this embodiment form a single continuous rounded surface; "side" of the body 170 is not distinctly defined by an edge or corner, as in the rectangular-shaped embodiments.

Figure 18:
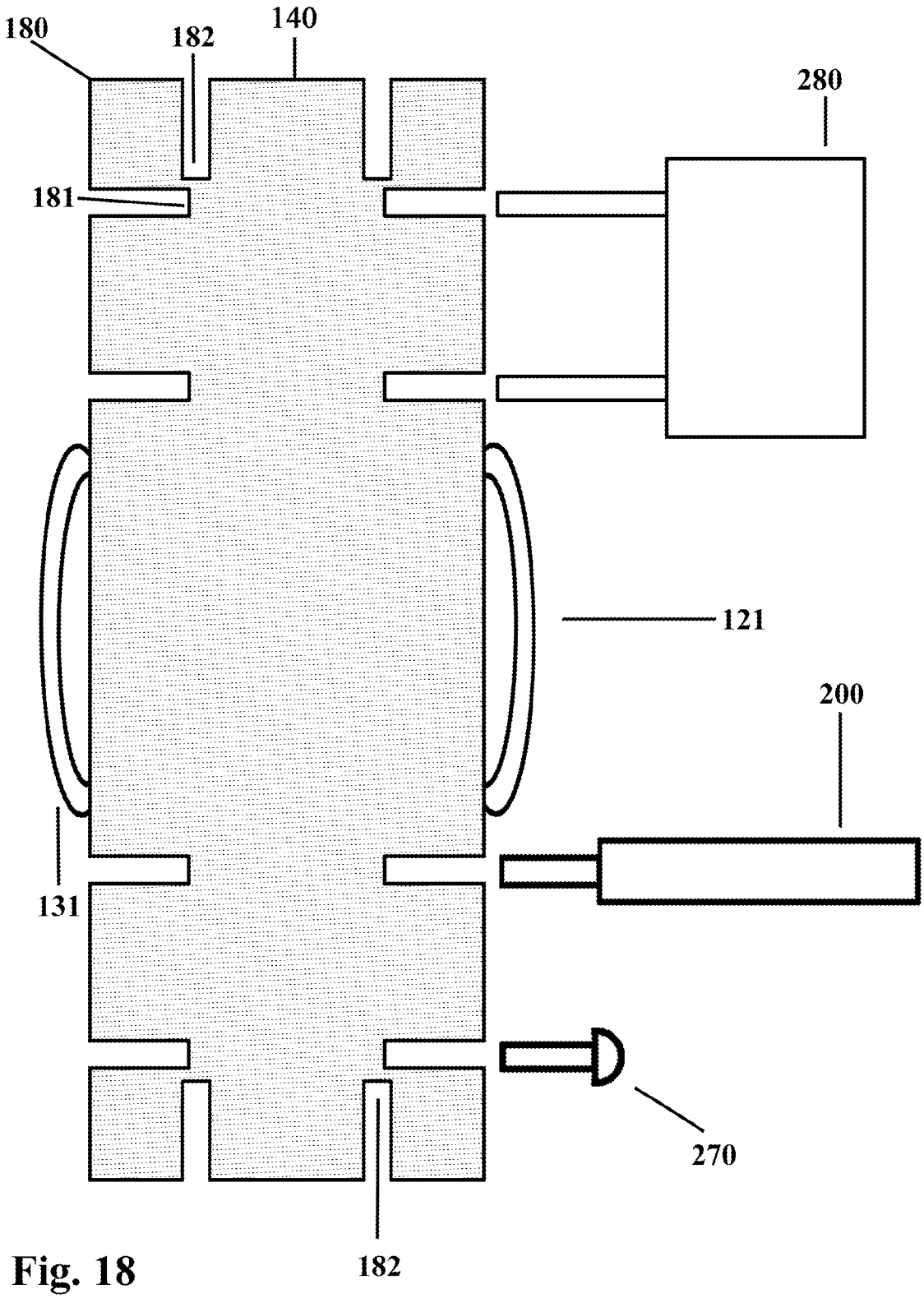

FIG. 18 is a front cross-sectional view of a base unit 180 of an alternative embodiment of the martial arts training device with regards to the inclusion of additional, alternatively-oriented accessory apertures. In this example, base unit 180 is of similar dimensions and shape to rectangular base unit 100, and is oriented in the standard upright position with the top side 140 facing the ceiling, but has additional accessory apertures 181 for flank-surface accessories and additional accessory apertures 182 for top and bottom-facing accessories. These accessory locations may be used for simulating various additional opponent attacks and offer a variety of additional targeting surfaces. The base unit 180 has vertical handles 121, 131, and may also have a horizontally-oriented handle (not shown) on an upper portion of a rear surface of the base unit 180. Depicted in a pre-attachment position along the right flank of the base unit 180 are: a targeting pad 280, an arm accessory 200, and a targeting plug 270.

Although example embodiments have been shown and described in this specification and figures, it would be appreciated by those skilled in the art that changes may be made to the illustrated and/or described example embodiments without departing from their principles and spirit.

What is claimed is:

1. A martial arts training system comprising:

a solid body formed of resilient material and comprising a front surface, a back surface, side surfaces, a top surface, and a bottom surface, the front surface comprising a plurality of holes arranged thereon for receiving at least one accessory;

at least one accessory comprising an attachment section shaped and sized to be received in a hole of the plurality of holes of the front surface and a training section adapted to extend from the front surface;

at least one handle; and a training stand, wherein: (a) the at least one handle is adapted to receive at least one hand of a training partner when being deployed in hand-held mode and to receive at least one attachment structure of the training stand when being deployed on the training stand; (b) the system is configurable by placement of the at least one accessory to simulate a first opponent having two arms and a leg; and (c) the system is configurable by placement of the at least one accessory to simulate a second opponent having a weapon.

2. The martial arts training system of claim 1, wherein the training section of the at least one accessory comprises an elongate and substantially cylindrical member which forms a contact target representing an opponent's arm.

3. The martial arts training system of claim 2, wherein the attachment section of the at least one accessory comprises an elongate and substantially cylindrical member having a diameter smaller than a diameter of the training section.

4. The martial arts training system of claim 1, wherein the training section of the at least one accessory comprises an elongate and substantially cylindrical member having a bend which forms a contact target representing an opponent's leg.

5. The martial arts training system of claim 1, wherein the training section of the at least one accessory comprises an elongate member which forms a contact target representing a rifle with a bayonet.

6. The martial arts training system of claim 1, wherein the training section of the at least one accessory comprises an elongate member which forms a contact target representing an opponent's forearm and hand holding a gun.

7. The martial arts training system of claim 1, wherein the training section of the at least one accessory comprises an elongate member which extends from the front surface at an angle from perpendicular and forms a contact target representing a sword or other martial arts/melee weapon.

8. The martial arts training system of claim 1, wherein the training section of the at least one accessory comprises a planar targeting pad which extends perpendicularly from the front surface and forms a contact target.

9. The martial arts training system of claim 1, wherein the at least one accessory is a targeting plug having a training section with a diameter greater than a diameter of the hole in which the training plug is received and which forms a contact target.

10. The martial arts training system of claim 9, wherein the targeting plug comprises ethylene vinyl acetate or polyurethane foam.

11. The martial arts training system of claim 1, wherein the at least one handle comprises: a first handle positioned on a portion of the back surface near the top surface; and at least a second handle positioned on one of the side surfaces.

12. The martial arts training system of claim 11, wherein the first handle and the at least one second handle are positioned to allow the training partner to hold the body during training use by gripping both the first handle and the second handle.

13. The martial arts training system of claim 11, wherein each of the handles comprises a center portion, between two end portions, which is adapted to be gripped, each end portion having a connector for attaching the handle to a surface of the body.

14. The martial arts training system of claim 11, wherein the first handle is oriented in a direction parallel with the top surface of the body.

15. The martial arts training system of claim 11, wherein the at least one second handle is oriented in a direction perpendicular to the top surface of the body.

16. The martial arts training system of claim 11, further comprising a third handle positioned on a side surface of the body opposite the side surface on which the at least one second handle is positioned.

17. The martial arts training system of claim 16, wherein the at least one second handle and the third handle are positioned to allow the training partner to hold the body during training use by gripping both the at least one second handle and the third handle.

18. The martial arts training system of claim 1, wherein the attachment section and the training section of the at least one accessory are configured so that a substantial portion of the at least one accessory extends from the front surface of the body when the attachment section is inserted into the hole.

19. The martial arts training system of claim 1, wherein the body is substantially rectangular in shape.

20. The martial arts training system of claim 1, wherein the plurality of holes is arranged in three columns which are positioned on the body to correspond to the left side, centerline, and right side of an opponent's torso.

21. The martial arts training system of claim 1, wherein the training stand comprises: an elongated member having a first end and a second end; a support structure connected to the first end of the elongated member; and at least one attachment structure positioned near the second end of the elongated member, the attachment structure being adapted to receive the first handle of the body to secure the body to the stand for training use.

22. The martial arts training system of claim 21, further wherein the support structure comprises a weighted base.

23. The martial arts training system of claim 1, wherein the body is semi-cylindrical in shape.

24. The martial arts training system of claim 1, wherein the body is shaped and sized to correspond to an opponent's upper torso and head.

25. The martial arts training system of claim 1, wherein at least one of the side surfaces comprises holes for receiving the at least one accessory member.

26. The martial arts training system of claim 1, wherein the body comprises ethylene vinyl acetate or polyurethane foam.

27. The martial arts training system of claim 26, wherein the body further comprises an outer covering formed of vinyl or plastic.

28. The martial arts training system of claim 1, wherein the at least one accessory comprises ethylene vinyl acetate or polyurethane foam.

29. The martial arts training system of claim 1, wherein the at least one accessory comprises plastic, metal, or wood.

30. The martial arts training system of claim 1, wherein the at least one accessory comprises straps or support members extending from an end portion of the training section nearest to the attachment section and having a connector at an end thereof.

31. The martial arts training system of claim 1, wherein the at least one accessory comprises a connector at an end of the attachment section.

32. The martial arts training system of claim 30, wherein the body comprises connectors positioned on the front surface around peripheries of the plurality of holes, the connectors being adapted to connect with the connectors of the straps or support members.

33. The martial arts training system of claim 30, wherein the body comprises connectors positioned on interior terminal surfaces of the plurality of holes, the connectors being adapted to connect with a connector at an end of the attachment section of the at least one accessory.

* * * * *